US006554380B2

(12) United States Patent
Moriyama et al.

(10) Patent No.: US 6,554,380 B2
(45) **Date of Patent: *Apr. 29, 2003**

(54) METHOD FOR DETECTING A LIQUID USED FOR DISCHARGE, AND A LIQUID DISCHARGING DEVICE

(75) Inventors: Jiro Moriyama, Kawasaki (JP); Yoshio Uchikata, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/942,943

(22) Filed: Oct. 2, 1997

(65) Prior Publication Data

US 2001/0050695 A1 Dec. 13, 2001

(30) Foreign Application Priority Data

Oct. 4, 1996 (JP) ..... 8-264385

(51) Int. Cl.[7] ..... B41J 2/175
(52) U.S. Cl. ..... 347/7; 347/86
(58) Field of Search ..... 347/7, 85–87; 399/24, 27; 73/304 R

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |

(List continued on next page.)

FOREIGN PATENT DOCUMENTS

| | | | |
|---|---|---|---|
| EP | 0 370 765 | 5/1990 | B41J/2/175 |
| EP | 0 370 884 | 5/1990 | G21C/3/18 |
| EP | 0 444 861 | 9/1991 | B41J/2/175 |
| EP | 0 496 642 | 7/1992 | B41J/2/175 |
| EP | 0 509 747 | 10/1992 | B41J/2/175 |
| EP | 0 626 261 | 11/1994 | B41J/2/05 |
| EP | 0 626 568 | 11/1994 | G01F/15/06 |
| EP | 0 661 162 | 7/1995 | B41J/2/195 |
| EP | 0 672 528 | 9/1995 | B41J/2/175 |
| JP | 59-123670 | 7/1984 | B41J/3/04 |
| JP | 59-138461 | 8/1984 | B41J/3/04 |
| JP | 63-158262 | 7/1988 | B41J/3/04 |
| JP | 63-304119 | 12/1988 | G01F/23/26 |
| JP | 64-63185 | 3/1989 | B41M/5/00 |
| JP | 2-208052 | 8/1990 | |
| JP | 6-126951 | 5/1994 | |
| JP | 6-297726 | 10/1994 | |
| JP | 8-80619 | 3/1996 | |
| WO | 97/27061 | 7/1997 | B41J/2/175 |

OTHER PUBLICATIONS

US 5,635,961, 6/1997, Sato (withdrawn)

*Primary Examiner*—Craig Hallacher
(74) *Attorney, Agent, or Firm*—Fitzpatrick, Cella, Harper & Scninto

(57) ABSTRACT

A liquid detection method and a liquid discharging device to detect whether or not a liquid can be supplied in a state in which a liquid channel from a tank for accommodating the liquid to each discharging port of a recording head is not disconnected by a bubble. A detection-signal input terminal is provided at a position where it contacts the liquid. A detection terminal is provided at a position where it does not electrically contact the liquid and is isolated from the liquid within the tank via a lower wall of the tank, made of an insulating plastic material, and the air. An electrical signal is input from a recording apparatus to the detection-signal input terminal via a connection terminal. The input electrical signal is transmitted through the ink within the recording head, the liquid channel within a joint, and the liquid within the tank. The detection terminal, comprising a conductive metal plate provided at a position corresponding to the entire lower surface of the tank, detects the waveform of a voltage. By comparing the detected voltage with a predetermined threshold, it is determined whether or not the liquid can be normally supplied.

48 Claims, 21 Drawing Sheets

U.S. PATENT DOCUMENTS

| | | | | | |
|---|---|---|---|---|---|
| 4,558,333 | A | | 12/1985 | Sugitani et al. | 347/65 |
| 4,723,129 | A | | 2/1988 | Endo et al. | 347/56 |
| 4,740,796 | A | | 4/1988 | Endo et al. | 347/56 |
| 4,786,846 | A | | 11/1988 | Uchida | 318/482 |
| 4,828,461 | A | | 5/1989 | Laempe | 417/132 |
| 4,853,718 | A | | 8/1989 | ElHatem et al. | 347/7 |
| 4,957,696 | A | | 9/1990 | Marechal et al. | 376/419 |
| 5,115,218 | A | | 5/1992 | Jean | 333/252 |
| 5,162,817 | A | | 11/1992 | Tajika et al. | 347/7 |
| 5,488,395 | A | * | 1/1996 | Takayanagi et al. | 347/7 |
| 5,500,664 | A | | 3/1996 | Suzuki et al. | 347/86 |
| 5,617,121 | A | | 4/1997 | Tachihara et al. | 347/7 |
| 5,638,097 | A | * | 6/1997 | Takayanagi et al. | 347/7 |
| 5,650,804 | A | | 7/1997 | Kawamura et al. | 347/19 |
| 5,682,184 | A | | 10/1997 | Stephany et al. | 347/7 |
| 5,721,574 | A | * | 2/1998 | Kubby | 347/7 |
| 5,735,167 | A | * | 4/1998 | Puukangas et al. | 73/304 C |
| 5,844,578 | A | * | 12/1998 | Mochizuki et al. | 347/7 |
| 5,992,961 | A | | 11/1999 | Ishikawa et al. | 347/7 |
| 6,022,090 | A | | 2/2000 | Coudray et al. | 347/7 |

* cited by examiner

METHOD FOR DETECTING A LIQUID USED FOR DISCHARGE, AND A LIQUID DISCHARGING DEVICE

BACKGROUND OF THE INVENTION

1. Field of the Invention

This invention relates to a liquid detection method and a liquid discharging device in which, in an ink-jet recording head used in a liquid discharging apparatus for recording (printing) characters and/or images by discharging ink droplets, a mechanism for detecting the remaining amount of ink within an ink tank for supplying ink to be discharged, and for determining continuity of ink from the ink tank to a portion near a discharging port, i.e., "disconnection of ink", is provided.

Recording (printing) is not necessarily performed on paper, but ink may be provided onto a recording medium such as cloth, string, film material, leather, metal, glass or the like.

More particularly, the present invention relates to a mechanism for detecting the state of ink used for recording in an ink tank for accommodating the ink, an ink channel for supplying a recording head with the ink, or a portion near a discharging port for discharging the ink.

2. Description of the Related Art

Recording apparatuses which utilize an ink-jet method of performing recording by discharging ink onto a recording material have been widely used due to ease of use.

An ink-jet recording apparatus includes an ink-jet head for discharging ink droplets, and an ink tank for accommodating ink to be supplied to the ink-jet head. The ink-jet head includes discharging ports for discharging the ink. A discharging-energy generation element for discharging the ink is provided near each of the discharging ports. A heating element for applying thermal energy to ink, a piezoelectric element for discharging ink by providing a mechanical pressure thereto, or the like is used as the discharging-energy generation element. The ink tank communicates with the discharging ports via an ink channel.

In the ink-jet recording apparatus, when ink within the ink tank decreases to a certain level, the ink cannot be supplied to the ink-jet head, so that normal discharge is disturbed and recording cannot be performed. Accordingly, in the ink-jet recording method, it is effective to provide a mechanism for detecting the remaining amount of ink and the absence of ink.

For example, the following methods for detecting the remaining amount of ink and a decrease in the remaining amount of ink have been known.

1. A method of detecting electric resistance and a state of conduction between two electrodes provided within the ink tank.

2. A method in which the ink tank is formed by a transparent material, an optical sensor is provided in the vicinity of the ink tank, and the presence of ink within the ink tank is detected by detecting the amount of light transmitted through the ink tank, or the amount of light reflected from a portion toward which the light is projected.

In order to detect the remaining amount of ink and a decrease in the remaining amount of ink, methods of detecting the presence of ink near the discharging ports have also been proposed. For example, the following method is disclosed in U.S. Pat. No. 4,853,718.

3. A method of detecting the electric resistance or the electrostatic capacitance between two electrodes provided in the vicinity of the discharging ports.

However, in method (1), in a recording apparatus in which the ink tank is exchanged by being separated from the head, when the remaining amount of ink in the ink tank becomes very small and the ink tank is replaced by a new ink tank, a portion relating to detection means, such as electrodes and the like, is also simultaneously replaced, thereby increasing the production cost of the ink tank, and the operating cost of the apparatus.

In method (2), a misoperation tends to occur due to stains on the surface of the ink tank or ink droplets adhered to the inner wall of the ink tank. In addition, a misoperation tends to occur in an ink tank having a light color, such as yellow.

In method (3), only ink near the discharging ports is detected, so that it is impossible to detect whether or not ink can be continuously supplied from the ink tank to the discharging ports, or the amount of ink within the ink tank.

When supplying ink from the ink tank to a discharging port of the ink-jet head, a bubble, in some cases, generates and grows in the liquid channel to the discharging port. When the bubble moves in accordance with the flow of ink and reaches the vicinity of the discharging port, the discharging port is filled with the bubble, even though the ink is present within the ink so as, to hinder the supply of the ink to the discharging port, thereby providing a state in which the ink is not discharged from the ink-jet head (this state will be hereinafter termed "nondischarge"). During a printing operation, a recording dot corresponding to the discharging port where nondischarge has occurred is not recorded (this state will be hereinafter termed "dot missing") thereby causing a failure in recording. Such a failure in recording causes degradation in the image quality. In addition, if it is necessary to perform another printing operation, a loss of time and useless consumption of an additional recording medium result. In addition, the element for generating the discharging energy of the ink-jet head may be forced to continuously generate the discharging energy in the of absence ink, thereby causing, in some cases, destruction of the element. Such a phenomenon in which the communication of ink from the ink tank to the discharging port is disconnected due to a bubble or the like is termed "disconnection of ink".

Such "disconnection of ink" cannot be detected according to the above-described methods (1), (2) and (3).

In order to prevent "disconnection of ink", a method is considered, in which a recovery operation of sucking ink from the discharging port is automatically performed before recording or at a periodic timing. In this method, however, since an operation of sucking ink is performed even in the absence of disconnection of ink, the amount of consumption of ink which does not contribute to recording increases if ink is frequently sucked in order to prevent disconnection of ink, resulting in an increase in the operating cost per sheet. This method also results in an increase in the size of a unit for storing sucked ink, thereby hindering attempts to produce a small and light ink jet recording apparatus.

SUMMARY OF THE INVENTION

The present invention has been made in consideration of the above-described problems.

It is an object of the present invention to provide a liquid detection method and a liquid discharging device capable of detecting whether or not a liquid can be supplied from a tank for accommodating the liquid to each discharging port of a recording head in a case that a liquid channel from the tank to each discharging port is not disconnected by a bubble.

It is another object of the present invention to provide a liquid detection method and a liquid discharging device capable of detecting the remaining amount of a liquid within a tank for accommodating the liquid and a state in which the remaining amount of the liquid, is very small.

The present invention which achieves these objectives relates to a liquid detection method in a configuration including a tank for accommodating a liquid, and a recording head for discharging the liquid supplied from the tank via a liquid channel from discharging ports onto a recording medium. The method includes the steps of inputting a voltage having a predetermined waveform to a first electrode provided at a portion near the discharging ports, detecting a waveform of a voltage generated at a second electrode provided at a portion near the tank, and determining a presence of the tank, the remaining amount of the liquid within the tank, or continuity of the liquid from the tank to a portion near the discharging ports based on the detected waveform of the voltage.

In one embodiment, the liquid is an ink having a coloring component for the recording medium, or a liquid having a component which has electric conductivity.

In another embodiment, the first electrode contacts the liquid, and the second electrode is provided at a position where it does not contact the liquid due to an insulator for electrically insulating the second electrode from the liquid.

In still another embodiment, the first electrode is provided at a position where it contacts the liquid via a protective film for electrically insulating the first electrode from the liquid.

In still another embodiment, the distance from the first electrode to the ink and the area of a portion of the first electrode faces that the ink are within a range to cause electrostatic induction from the first electrode to the ink by the input voltage having the predetermined waveform.

In still another embodiment, the first electrode is provided at a position where it directly contacts the liquid.

In still another embodiment, the second electrode is provided at a position where it contacts the liquid via a protective film for electrically insulating the second electrode from the liquid.

In still another embodiment, an insulator for electrically insulating the second electrode from the liquid is provided between the liquid and the second electrode, and the second electrode does not contact the liquid.

In still another embodiment, the distance from the second electrode to the ink and the area of a portion of the second electrode that faces the ink are within a range to cause electrostatic induction from the second electrode to the ink by the input voltage having the predetermined waveform.

In still another embodiment, the recording head includes a plurality of electrothermal transducers for applying thermal energy to the liquid as discharging means for discharging the liquid from the discharging ports.

According to the above-described configuration, it is possible to detect the presence of the liquid in the tank or in the liquid channel from the tank to the discharging ports, and a state of disconnection of the liquid channel due to the presence of a bubble in the liquid channel.

By appropriately disposing the terminal for detection, it is also possible to detect the remaining amount of the liquid within the tank, as well as the mounting/detaching of the tank in the case of a configuration in which the tank can be separated from the recording head.

The present invention which achieves these objectives relates to a liquid discharging device including a tank for accommodating a liquid, and a recording head for discharging the liquid supplied from the tank via a liquid channel from discharging ports onto a recording medium. The device includes a first electrode provided at a portion near the discharging ports, a second electrode provided at a portion near the tank, detection means for inputting a voltage having a predetermined waveform to the first electrode and detecting a waveform of a voltage generated at the second electrode, and control means for determining a presence of the tank, a remaining amount of the liquid within the tank, or continuity of the liquid from the tank to a portion near the discharging ports based on the waveform of the voltage detected by the detection means.

In one embodiment, the liquid is an ink having a coloring component for the recording medium, or a liquid having a component reacting on the ink, which has electric conductivity.

In another embodiment, the first electrode is provided at a position where it contacts the liquid via a protective film for electrically insulating the first electrode from the liquid.

In still another embodiment, the distance from the first electrode to the ink and the area of a portion of the first electrode that faces the ink are within a range to cause electrostatic induction from the first electrode to the ink by the input voltage having the predetermined waveform.

In still another embodiment, the first electrode is provided at a position where it directly contacts the liquid.

In still another embodiment, the second electrode is provided at a position where it contacts the liquid via a protective film for electrically insulating the second electrode from the liquid.

In still another embodiment, an insulator for electrically insulating the second electrode from the liquid is provided between the liquid and the second electrode, and the second electrode does not contact the liquid.

In still another embodiment, the distance from the second electrode to the ink and the area of a portion of the second electrode that faces the ink are within a range to cause electrostatic induction from the second electrode to the ink by the input voltage having the predetermined waveform.

In still another embodiment, the first electrode contacts the liquid, and the second electrode is provided at a position where it does not contact the liquid due to an insulator for electrically insulating the second electrode from the liquid.

In still another embodiment, the first electrode and the second electrodes are provided at positions where they directly contact the ink.

In still another embodiment, the first electrode is maintained at a 0-level voltage except when detecting the ink.

In still another embodiment, the first electrode also operates as an electrode terminal used for driving or controlling the recording head.

In still another embodiment, the recording head includes a plurality of discharging means for discharging the liquid from the discharging ports, and the first electrode is an electrode, commonly connected to predetermined discharging means from among the plurality of discharging means, for driving the predetermined discharging means.

In still another embodiment, the recording head includes discharging means for discharging the liquid from the discharging ports, and the first electrode is an electrode grounded for driving the discharging means.

In still another embodiment, the recording head includes a plurality of discharging ports for discharging the liquid from the discharging ports, and the first electrode is an electrode, connected to each of the plurality of discharging means, for driving the discharging means.

In still another embodiment, the recording head includes an identifying terminal where a signal for identifying the recording head is input, and the first electrode also operates as the identifying terminal.

In still another embodiment, the recording head includes a plurality of electrothermal transducers for applying thermal energy to the liquid as discharging means for discharging the liquid from the discharging ports, and the first electrode comprises a protective member for protecting the electrothermal transducers.

In still another embodiment, the protective member is made of tantalum or tantalum oxide.

In still another embodiment, the second electrode is provided at a position adjacent to the tank so as to be horizontal with respect to a lower portion of the tank.

In still another embodiment, the second electrode is provided at a position adjacent to the tank in a vertical direction along a wall portion of the tank.

In still another embodiment, the second electrode is provided at a terminal between the tank and the recording head, and the control means determines a state of disconnection of ink in an ink channel between the terminal and the discharging ports.

In still another embodiment, the recording head includes a filter portion for filtering the liquid supplied from the tank, and the terminal is provided on the filter portion of the recording head, or on a joint portion between the tank and the recording head.

In still another embodiment, the device further includes a carriage for mounting the recording head and the tank, and scanning means for performing reciprocating scanning of the carriage relative to the recording medium. The second electrode is provided on a head holder unit for supporting the recording head, or on the carriage, or at a position of the liquid discharging device where the scanning by the carriage is not performed.

In still another embodiment, a plurality of the tanks and a plurality of the recording heads are provided so as to correspond to a plurality of liquids.

In still another embodiment, a plurality of the first electrodes and a plurality of the second electrodes are provided so as to correspond to the plurality of liquids.

In still another embodiment, a plurality of first electrodes are provided so as to correspond to the plurality of liquids, and the second electrode is integrally provided on the plurality of tanks at a position adjacent to the plurality of tanks.

In still another embodiment, a size of the second electrode substantially equals a width of the plurality of tanks.

In still another embodiment, the first electrode is provided commonly to the plurality of liquids, and a plurality of the second electrodes are independently provided for corresponding ones of the plurality of tanks.

In still another embodiment, the control means sequentially detects the plurality of liquids.

In still another embodiment, the tank is integrally configured with respect to the recording head.

In still another embodiment, the tank is configured so as to be separable from the recording head, and the tank and the recording head can be independently exchanged.

In still another embodiment, the device further includes display means for displaying a result of the determination by the control means.

In still another embodiment, the device is connected to host means capable of transferring data relating to recording, and a result of the determination by the control means is transmitted to the host means.

In still another embodiment, the device further includes recovery means for performing a recovery operation for the recording head, and the control means causes the recovering means to perform a recovery operation when the control means has determined that ink is discontinuous in the liquid channel from the tank to one of the discharging ports of the recording head.

In still another embodiment, the recording head includes a plurality of electromechanical transducers for applying discharging energy to the liquid as discharging means for discharging the liquid from the discharging ports.

In still another embodiment, the recording head includes a plurality of electrothermal transducers for applying thermal energy to the liquid as discharging means for discharging the liquid from the discharging ports.

According to the above-described configuration, it is possible to detect the presence of the liquid in the tank or in the liquid channel from the tank to the discharging ports, and to detect a state of disconnection of the liquid channel due to the presence of a bubble in the liquid channel. By appropriately disposing the terminal for detection, it is also possible to detect the remaining amount of the liquid within the tank, as well as the mounting/detaching of the tank in the case of a configuration in which the tank can be separated from the recording head.

According to the configuration of the present invention, it is possible to inexpensively detect a liquid, and to detect a liquid in each of tanks having various kinds of liquids, and liquids for a plurality of recording heads by the same means.

According to the configuration of the present invention, it is possible to detect even a liquid having a very light color as well as a transparent liquid without being restricted by the composition and the color of the liquid, and to perform detection in a very short time and without consuming the liquid.

The foregoing and other objects, advantages and features of the present invention will become more apparent from the following description of the preferred embodiments taken in conjunction with the accompanying drawings.

DESCRIPTION OF THE PREFERRED EMBODIMENTS

Preferred embodiments of the present invention will now be described in detail with reference to the drawings.

First Embodiment

Figure 1:
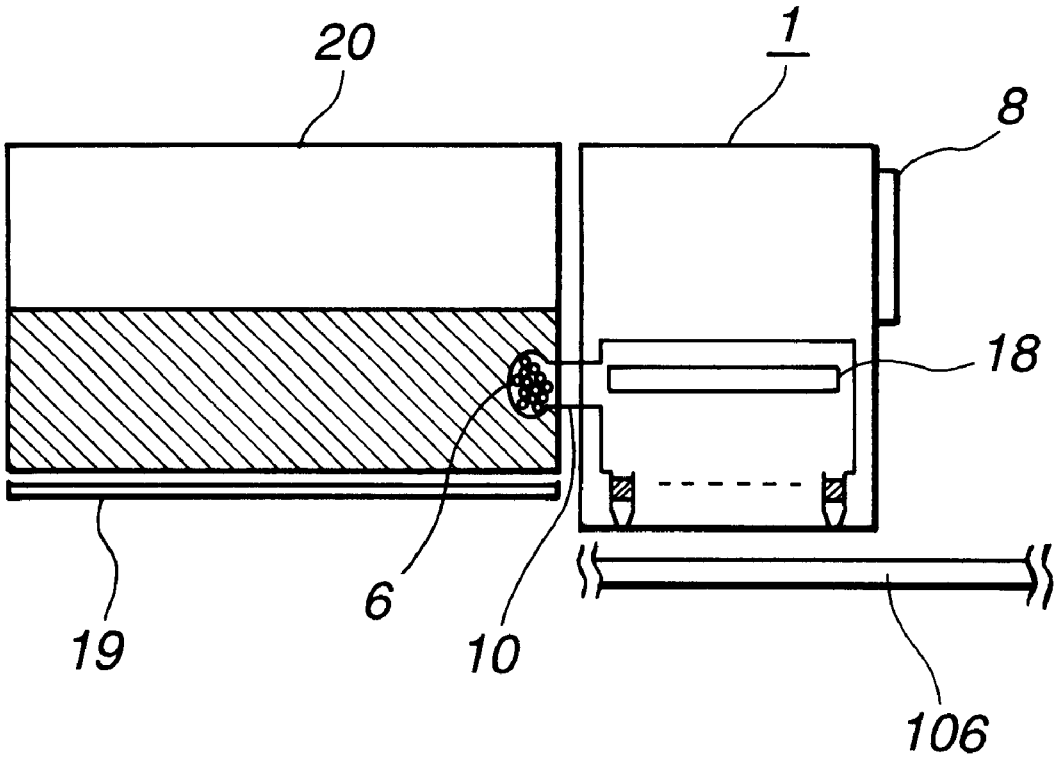
FIG. 1 is a diagram illustrating the configuration of a recording head according to a first embodiment of the present invention.

FIG. 1 is a diagram illustrating the configuration of a recording head in an ink-jet printer, serving as a recording apparatus, according to a first embodiment of the present invention. In FIG. 1, a recording head 1 and ink tanks 20 perform scanning in a direction perpendicular to the plane of FIG. 1, to form characters and/or images.

Ink within each of the ink tanks 20 is supplied to the recording head 1 via a filter 6, and a joint 10 having a liquid channel therein. The supplied ink is discharged onto a recording medium 106 by the recording head 1 in accordance with a recording signal, to perform recording. The recording signal is transmitted from the recording apparatus to the recording head 1 via a connection terminal 8, serving as an electrical contact with the recording apparatus.

An outline of ink detection is as follows. That is, an electrical signal is input fom the recording apparatus to a detection-signal input terminal 18 disposed at a portion near the discharging ports of the recording head 1 via the connection terminal 8. The input electrical signal is transmitted through the ink within the recording head 1, the ink channel within the joint 10, and the ink within the ink tank 20, and is detected by a detection terminal 19, comprising a conductive metal plate, provided at a position corresponding to the entire lower surface of the ink tank 20 in a state of not electrically contacting the ink tank 20.

The detection-signal input terminal 18 directly contacts the ink. The detection terminal 19 does not electrically contact the ink, and is insulated from the ink within the ink tank 20 via the lower wall of the ink tank 20 made of an insulating plastic material, and the air.

The ink-jet printer of the first embodiment can form an image using inks of four colors, i.e., yellow (hereinafter abbreviated as Y), magenta (hereinafter abbreviated as M), cyan (hereinafter abbreviated as C) and black (hereinafter abbreviated as K). The area of a portion where the detection terminal 19 faces the lower wall of an ink tank corresponding to each color is about 10×40 mm, and the distance between the detection terminal 19 and the lower surface of ink is about 10 mm. Since the detection terminal 19 is common to each color and is integrated with the ink tanks, the size of the detection terminal 19 is about 49 mm×40 mm.

A narrow the gap between the detection terminal 19 and the lower wall of the ink tank and the air is advantageous for ink detection, because the coupling coefficient of electrostatic coupling between the ink and a second electrode (the detection terminal 19) (to be described later) changes as the gap changes.

As described above, a first electrode (the detection-signal input terminal) is provided in the vicinity of the discharging ports, and the second electrode (the detection terminal) is provided in the vicinity of the ink tank. A voltage having a specific waveform is input to the first electrode, and continuity of the liquid within the ink tank from the ink tank to a portion near the discharging ports is determined by detecting the waveform of the voltage at the second electrode.

In the following description, the word "ink" indicates not only colored ink used for recording, but also a liquid which operates on or reacts with ink on a recording medium altough it is not directly used for recording. For example, a colorless or light-color liquid, which improves the water resisting property of discharged ink by reacting on a colored ink dye or a component of ink, may be used.

Electric conductivity is required for the liquid. However, since the detection terminal does not electrically contact the input signal and is separated from the liquid with a high impedance, the liquid is required to have only a small electric conductivity. For example, almost all liquids including water have electric conductivity.

Figure 2A:
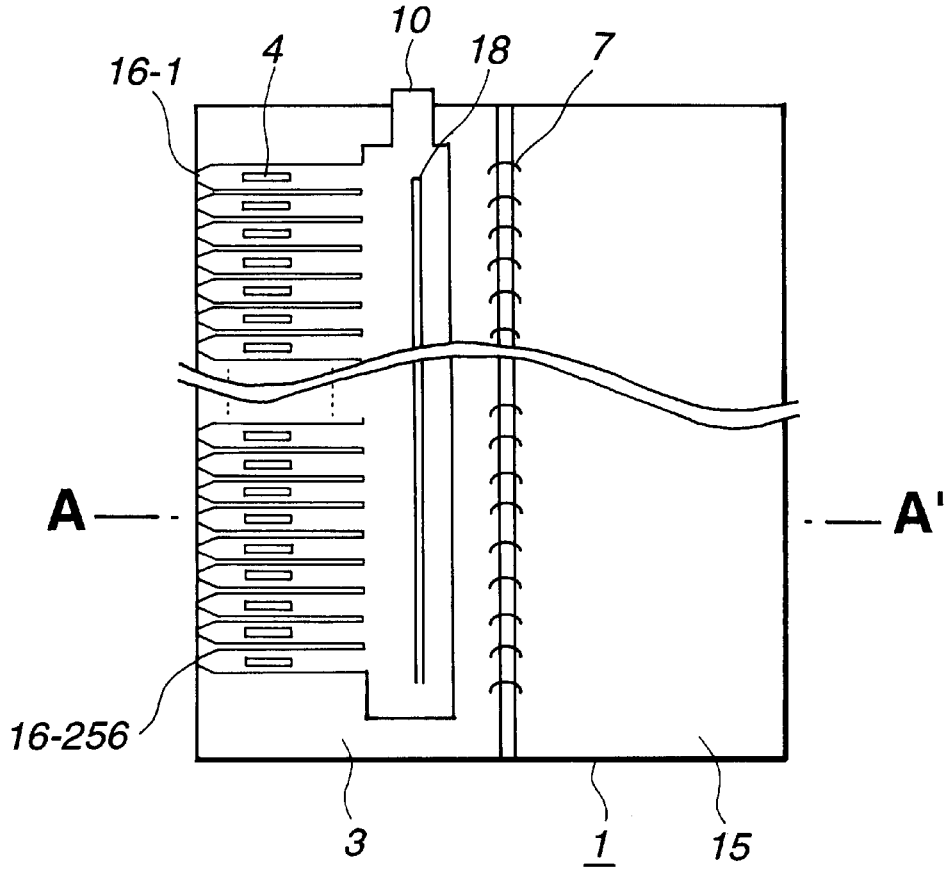
FIGS. 2A and 2B are enlarged cross-sectional views of the recording head shown in FIG. 1.
Figure 2B:
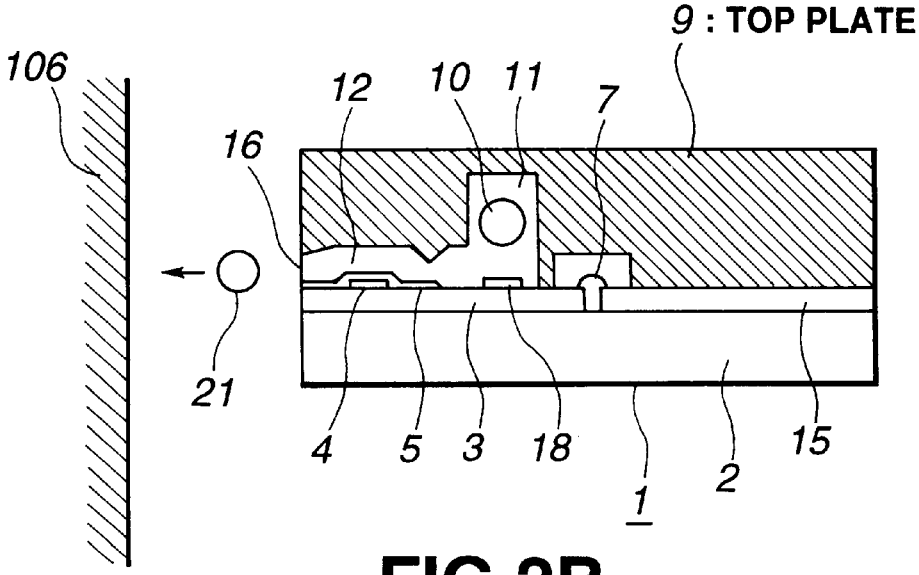

FIGS. 2A and 2B are enlarged cross-sectional views of the recording head 1: FIG. 2A is a cross-sectional view; and FIG. 2B is a cross-sectional view taken along line A–A' shown in FIG. 2A. FIGS. 2A and 2B illustrate the detailed configuration of a recording head for a single color.

The recording head 1 includes an element substrate 3, serving as an ink-discharge control substrate unit made of silicon, and a PCB (printed circuit board) 15, both fixed on a base material 2, which is a substrate mainly made of aluminum, using an adhesive. Heating elements 4 for discharging ink by heating during ink discharge are formed on the element substrate 3. Each of the heating elements 4 is covered with a protective film 5 made of silicon oxide so as not to directly contact ink.

In the recording method according to the first embodiment, each of the heating elements 4 is disposed in a pressure chamber 12 corresponding to a discharging port 16. By applying a driving signal corresponding to recording information to the heating element 4, an ink droplet 21 is discharged from the discharging port 16 toward a recording medium 106 to record characters and/or images.

Figure 3:
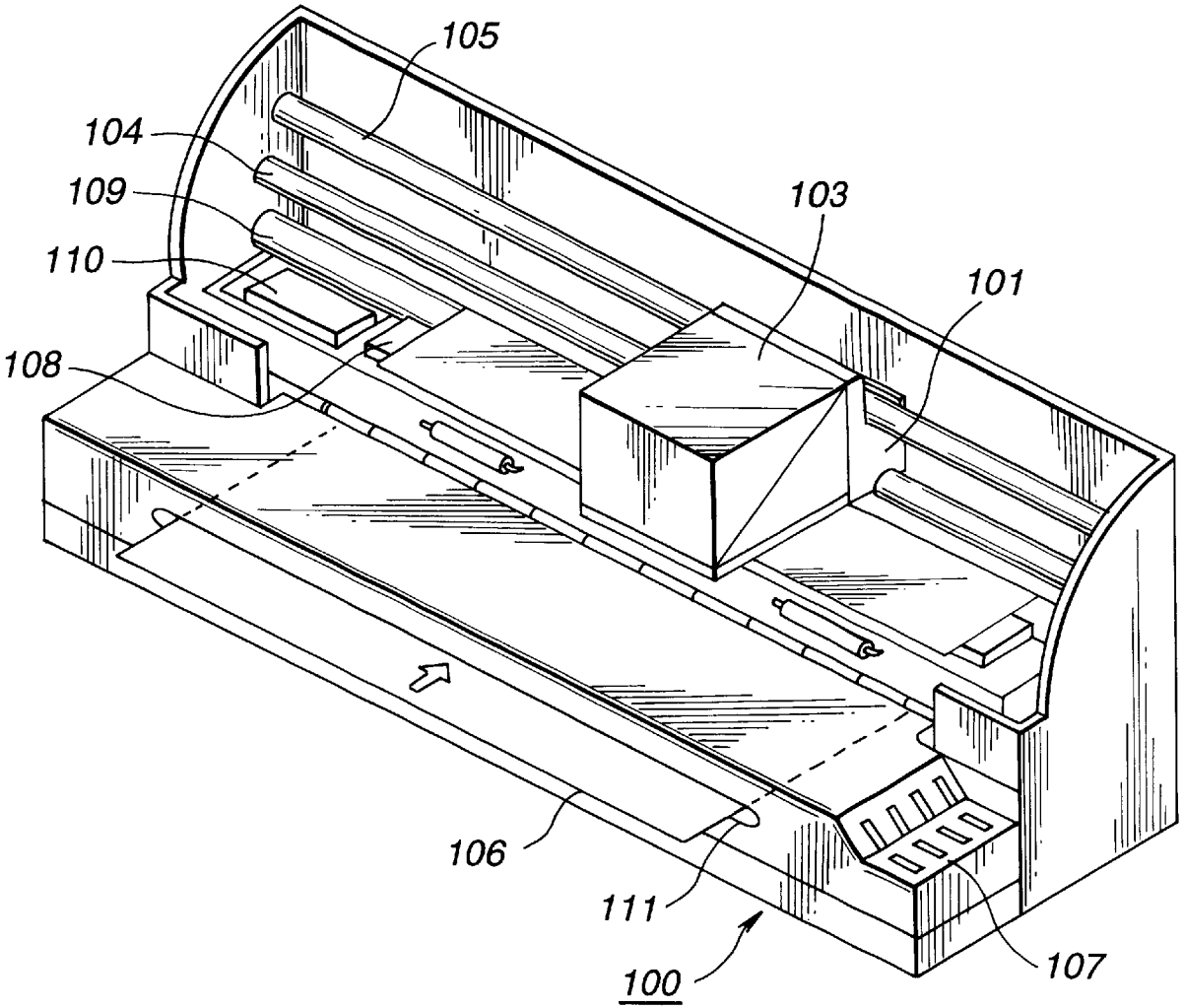
FIG. 3 is a perspective view illustrating an ink-jet recording apparatus according to the first embodiment.

FIG. 3 is a perspective view of the ink-jet printer. In FIG. 3, the recording medium 106 inserted at a sheet feeding position of a recording apparatus 100 is conveyed to a recordable region of a recording-head unit 103 by a feeding roller 109. A platen 108 is provided below the recording medium in the recordable region. A carriage 101 can be moved in a determined direction by two guide shafts 104 and 105 to perform reciprocating scanning of the recording region. The ink tanks 20 for supplying inks of four colors, and the recording-head unit 103 including the recording head 1 for discharging the inks are mounted on the carriage 101. Reference numeral 107 represents switches and a display panel, which displays setting of various kinds of recording modes and the state of the recording apparatus.

Figure 4:
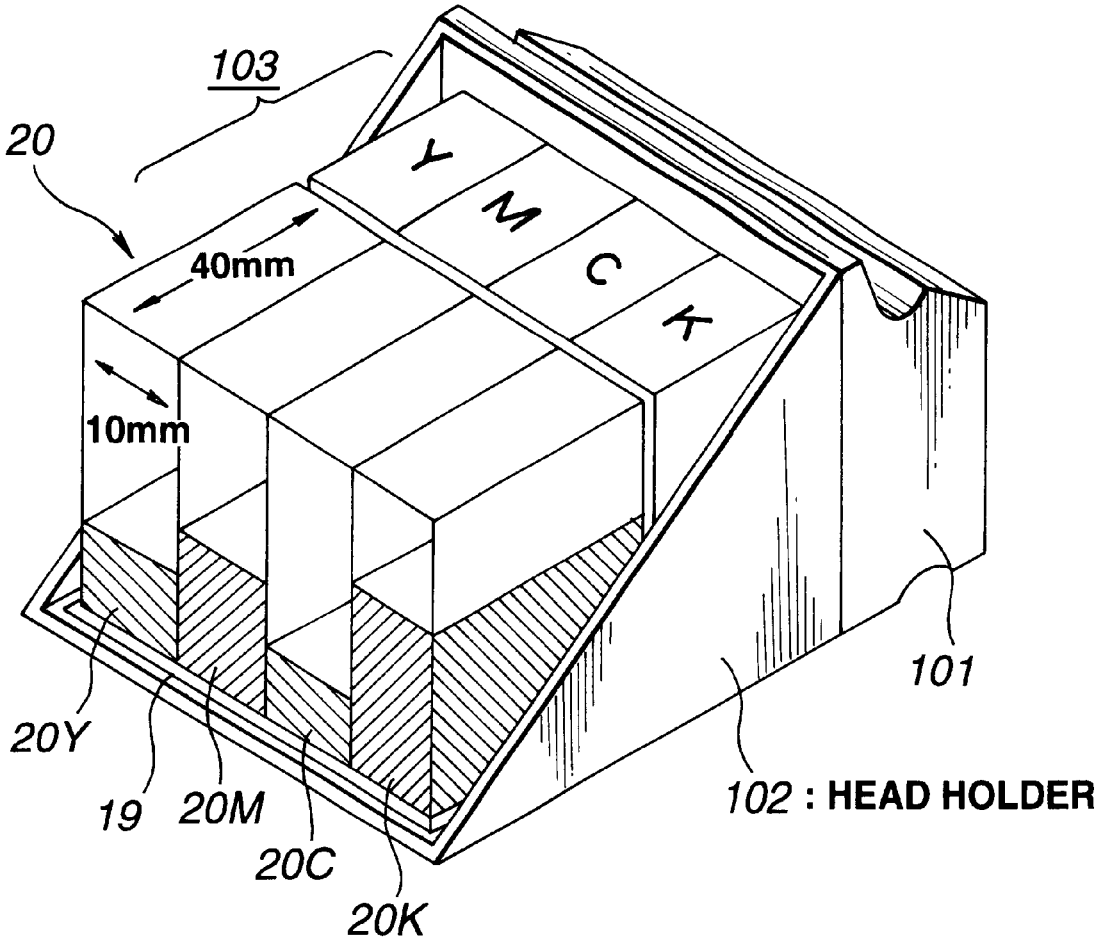
FIG. 4 is a perspective view illustrating the detail of a recording-head unit of the ink-jet recording apparatus shown in FIG. 3.

FIG. 4 is a perspective view of the entirety of the recording head unit 103. In FIG. 4, a black ink tank 20K for accommodating black ink (K), and tanks 20C, 20M and 20Y for accommodating C, M and Y inks can be independently exchanged from the recording-head unit 103. Although recording heads are integrated so as to correspond to inks of four colors, the present invention is not limited to such a configuration. For example, the ink tanks 20 may be separated from the recording head 1.

The recording heads for respective colors are separated from one another at a distance of about ½ inch. Each of the recording heads for colors K, C, M and Y includes 300 discharging ports 16, which are substantially linearly arranged so that a recording dot corresponding to each discharging port is recorded with a dot density of 600 dpi (dots per inch).

Figure 5:
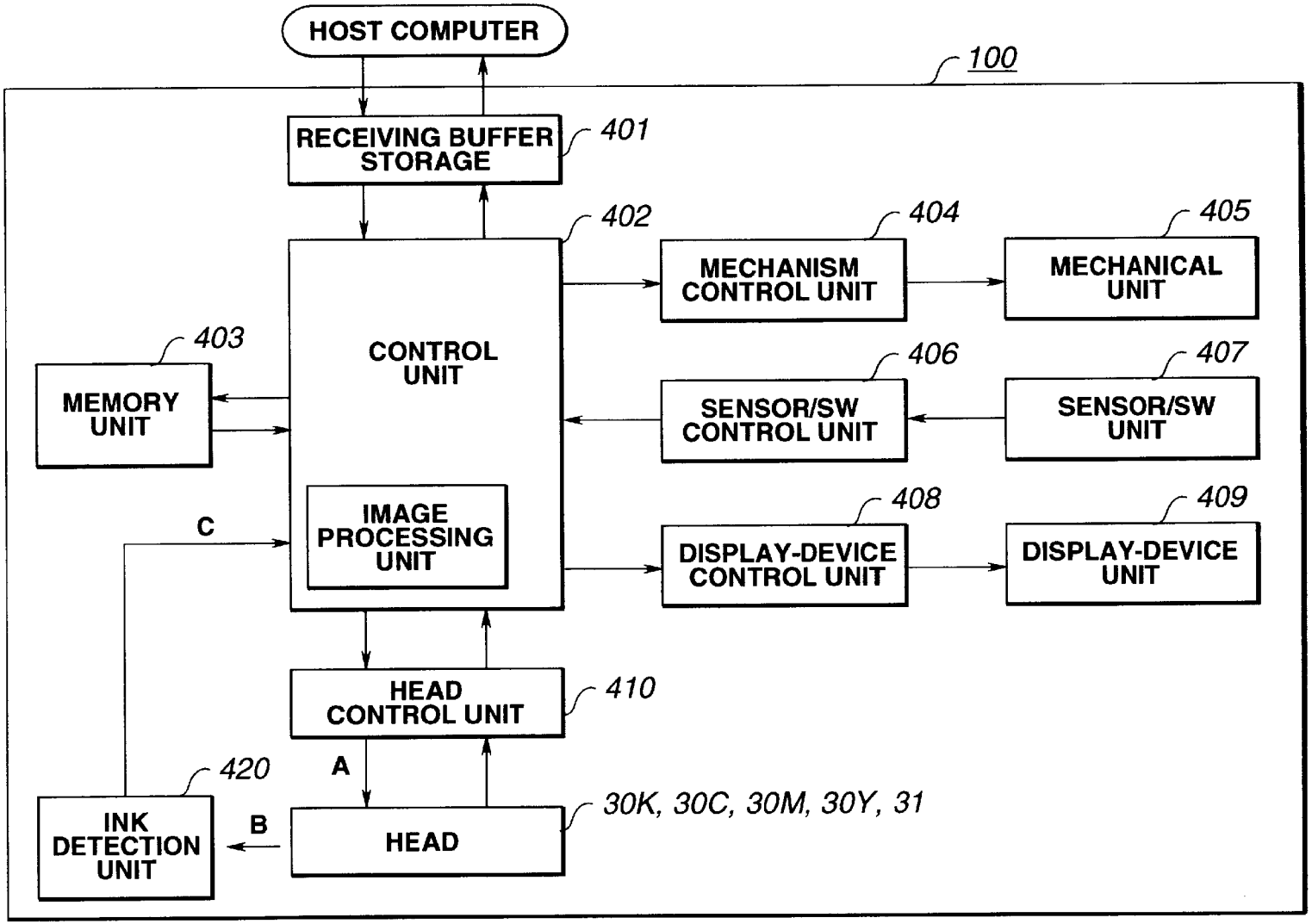
FIG. 5 is a block diagram illustrating the control of the ink-jet recording apparatus shown in FIG. 3.

FIG. 5 is a block diagram of the ink-jet recording apparatus. Data of characters and/or images to be recorded (hereinafter termed "recording data") is input from a host computer to a receiving buffer storage 401 of the recording apparatus. Data confirming if data is correctly transferred and data indicating the operational state of the recording apparatus are transmitted from the recording apparatus to the host computer. The data stored in the receiving buffer storage 401 is transferred to a memory unit 403 under the control of a control unit (CPU (central processing unit)) 402, and is temporarily stored in a RAM (random access memory). A mechanism control unit 404 drives a mechanical unit 405, including a carriage motor, a line feeding motor and the like, according to instructions from the CPU 402. A sensor/SW control unit 406 transmits signals from a sensor/SW unit 407, including various kinds of sensors and SW's (switches), to the CPU 402. A display-device control unit 408 controls display devices, such as LED's (light-emitting diodes) or the like, on a display-device unit 409 according to instructions from the CPU 402. A head control unit 410 controls a recording head according to an instruction from the CPU 402, and also senses temperature information and the like indicating the state of the recording head and transmits the obtained information to the CPU 402.

The flow of ink detection is as follows. That is, first, a signal for ink detection is input from the head control unit 410 to the recording head as indicated by an arrow A. This signal is then transmitted to an ink detection unit 420 as indicated by an arrow B and is digitized, and the obtained signal is transmitted to the CPU 402.

Figures 6A, 6B, 6C, 6D, 6E:
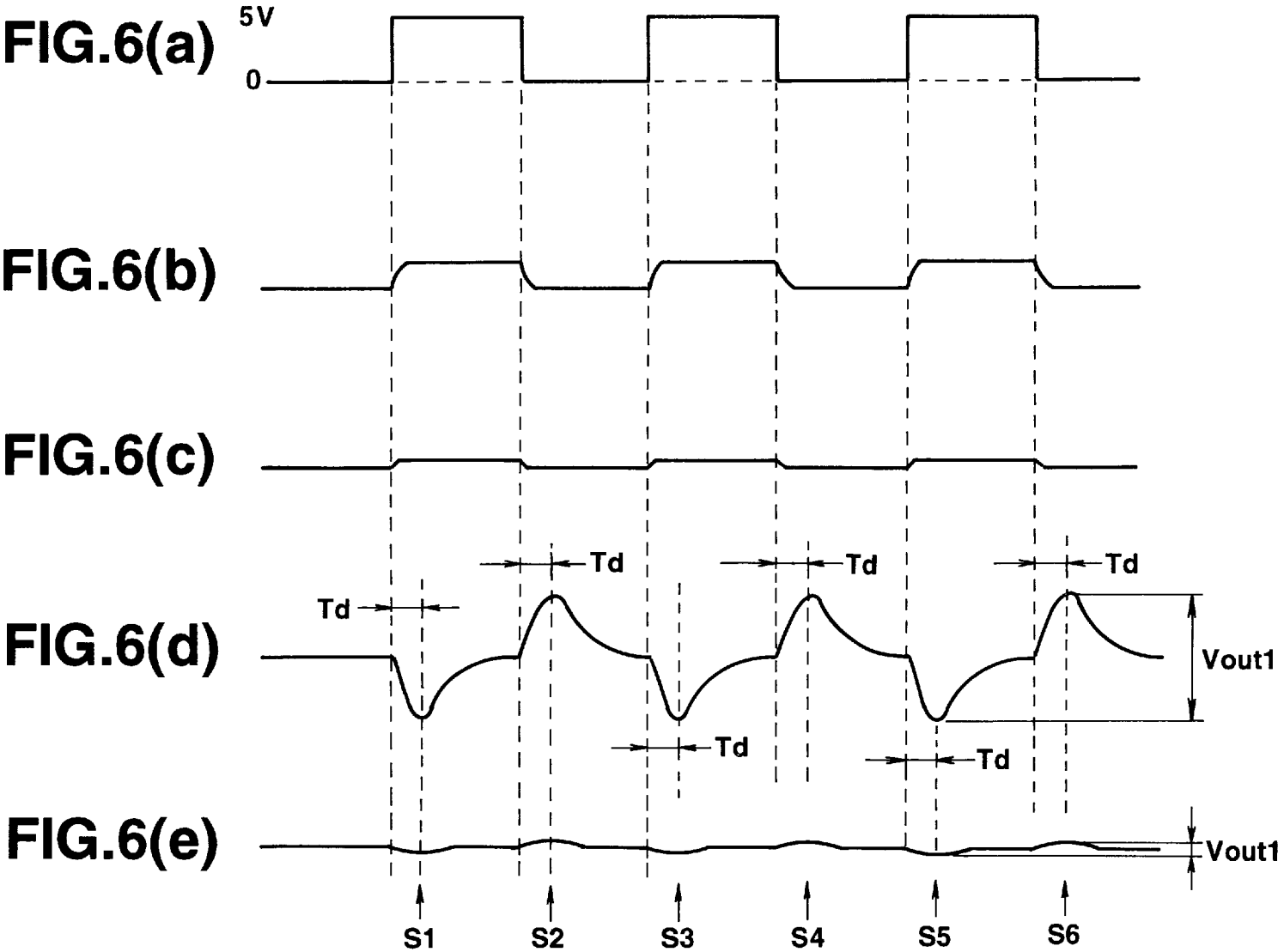
FIGS. 6(*a*) through 6(*e*) are diagrams illustrating an input signal and a detection signal when detecting ink.

FIGS. 6(*a*) through 6(*e*) illustrate an input signal for ink detection and a detection signal in the ink detection unit 420. FIGS. 6(*a*) and 6(*b*) illustrate the input signal and the detection signal, respectively.

In a normal state, portions from the ink tank to the discharging ports of the recording head are electrically connected to each other via the ink. Accordingly, when, for example, a signal of 5 V having a 10-kHz rectangular waveform is input to the detection-signal input terminal 18, a signal having substantially the same waveform as the waveform of the input signal is detected at the detection terminal 19. This is because charges at the input terminal 18 are transmitted through the ink in the liquid channel and induce charges at the detection terminal 19, having a relatively large area present at a position close to the ink while not contacting it. However, the voltage level of the detected signal is smaller than the voltage of the input signal. This is because the amount of induced charges is smaller than the amount of charges which would be transmitted in a state in which electric resistance between input terminal 18 and detection terminal 19 is 0.

Although it depends on the circuit configuration and the circuit constant, the waveform of the detection signal is more or less rounded. This is because certain amounts of inductive component, capacitive component and resistive component are present in the equivalent circuit from the input terminal to the detection terminal in addition to the resistive component of the ink and the capacitive component of the detection unit.

FIG. 6(*c*) illustrates a detection signal when ink within the ink tank is used up and ink is disconnected (discontinuous) at some portion from the ink tank to the pressure chamber within the recording head via the joint portion, i.e., when the above-described disconnection of ink occurs. The detection level of the signal shown in FIG. 6(*c*) is smaller than the signal shown in FIG. 6(*b*). If a recording operation is performed in a state in which the signal shown in FIG. 6(*c*) is detected, recording cannot be performed because the supply of ink from the ink tank is interrupted. Furthermore, by heating the recording-head unit in a state in which ink is not supplied, the recording head is degraded. When the supply of ink is continuous from the ink tank to the discharging ports, ink whose amount equals the amount of ink discharged from the discharging ports is normally supplied from the ink tank. However, if a discontinuous portion is present in the ink supply path, the air in the discontinuous portion reaches a discharging port sooner or later, thereby causing nondischarge, i.e., a state of insufficient recording.

By determining if the detection signal for the input signal shown in FIG. 6(*a*) is a signal as shown in FIG. 6(*b*) or 6(*c*), it is determined whether or not disconnection of ink has occurred, i.e., if recording can be performed or cannot be performed, respectively. When a detection signal as shown in FIG. 6(*b*) has been obtained, recording can be performed. On the other hand, when a detection signal as shown in FIG. 6(*c*) has been obtained, recording should not be performed.

In this ink detection system, an input signal is transmitted from a portion near the discharging ports of the recording head to the ink tank via ink in the ink channel, and a detection signal is obtained by electrostatic coupling between the ink tank and the detection terminal. Since the detection terminal does not contact ink, little current flows through the ink. Accordingly, even if the input terminal directly contacts the ink, any chemical reaction caused by charges of the ink is very minor, so that the components of the ink do not change by the chemical reaction to a degree which would influence recording.

FIGS. 6(*d*) and 6(*e*) illustrate detection signals obtained when the detection system uses circuitry different from that of the above-described system.

Figure 7A:
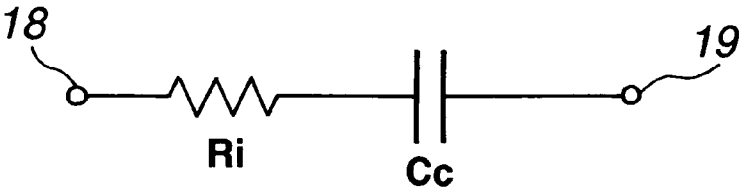
FIGS. 7A and 7B are diagrams illustrating an ink detection circuit in the first embodiment.
Figure 7B:
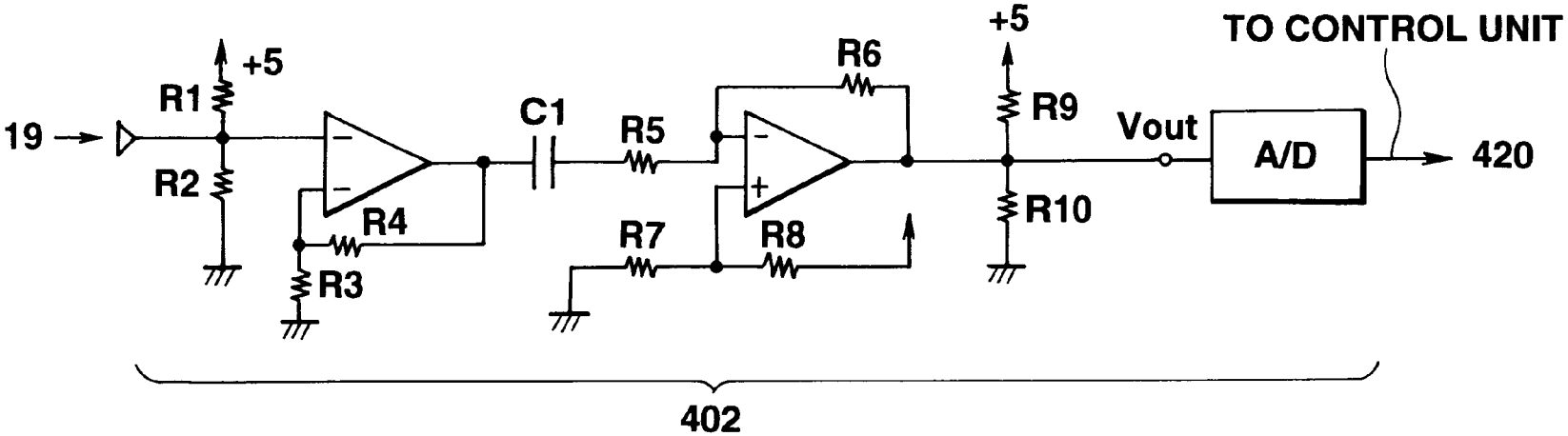

FIGS. 7A and 7B illustrate such a detection circuit system. FIG. 7A is a simplest equivalent circuit for the ink and the ink tank. FIG. 7B is a diagram illustrating a detection circuit having countermeasures against static electricity and an amplification function. Ink detection in the dection circuit shown in FIG. 7B will now be described.

FIGS. 6(*d*) and 6(*e*) illustrate detection signals $V_{out}$ for the input signal shown in FIG. 6(*a*): FIG. 6(*d*) illustrates a detection signal in a normal state; and FIG. 6(*e*) illustrates a detection signal when "disconnection of ink" has occurred.

In FIG. 7A, the input signal reaches the wall of the ink tank via the ink. Although the detection terminal does not contact the ink, the detection terminal is electrostatially coupled to the ink and is therefore equivalent to a capacitor.

Hence, a change in the potential of the input signal is transmitted to the detection terminal in a state of AC coupling.

In FIG. 7B, resistors R1 and R2 are provided as countermeasures against static electricity, and in order to stabilize the level of the detection signal. Two operational amplifiers are also provided for amplifying the detection signal. A capacitor C1 provides AC coupling to the next stage. The obtained detection signal $V_{out}$ has a waveform shown in FIG. 6(*d*) when recording can be performed, and has a waveform shown in FIG. 6(*e*) when recording cannot be performed. When "disconnection of ink" occurs, the signal is not transmitted to the detection terminal because the resistance $R_i$ of the ink becomes infinite, so that the detection signal $V_{out}$ has the waveform shown in FIG. 6(*e*). In practice, a small signal is obtained due to a leakage signal.

The detection signal $V_{out}$ is converted into a digital signal by an A/D converter in the following stage at a timing synchronized with the input signal. The synchronized timing corresponds to a delay time $T_d$ with respect to the input signal. The delay time $T_d$ is a constant determined by the electric conductivity of ink, the shape of the liquid channel from the ink tank to a portion near the discharging ports, and the detection circuit system, and is measured as a time period from the input of the input signal to a time when the waveform of the detection signal $V_{out}$ has a value close to a peak.

A measured value obtained by repeating A/D conversion a plurality of times is used for ink detection, in order to reduce measurement error due to noise and the like. More specifically, signals in three periods are measured. Timings of measurement are S1, S2, S3, S4, S5 and S6 shown in FIGS. 6(*d*) and 6(*e*). The sum of measured values at the timings S1, S3 and S5 is subtracted from the sum of measured values at the timings S2, S4 and S6, and the obtained value is divided by 3 to provide a mean value in repetition of three periods as the detection signal $V_{out}$1 to be read by the control unit. The number of measurements and the processing method are not limited to the above-described ones, and any other appropriate approach may also be adopted.

It is determined whether or not recording can be performed according to whether or not the detection signal $V_{out}$1 is greater than a preset value $Vd_{th}$, respectively.

In the forgoing description, detection signals are measured a plurality of times in order to remove noise during measurement. Since the time period of measurement is shorter that the time period of recording, the total recording time period is not significantly increased even by performing measurement a plurality of times.

In some cases, specific preset value $V_{th}$ is necessary for each of a plurality of colors. This is because, in some cases, an optimum value of $V_{th}$ differs for each color depending on the conductivity of ink, the equivalent circuit of the measuring system, and the configuration of the detection circuit. In such a case, it is preferable to set $V_{th}Y$, $V_{th}M$, $V_{th}C$ and $V_{th}K$ as $V_{th}$'s for colors Y, M, C and K, respectively. By thus independently setting a threshold suitable for ink of each color, it is possible to appropriately determine whether or not the ink-jet head for each color should perform recording.

In order to suppress electrochemical, reaction caused by the flow of current in ink, it is desirable to maintain the level of the input terminal at a 0 level (GND level) except when inputting a signal to the input terminal during ink detection.

When inks of a plurality of colors are used in ink detection, it is desirable to set input terminals which are not in a state of measurement to a 0 level, in order to prevent induction of charges via adjacent ink tanks to degrade accuracy in detection.

Figure 8:
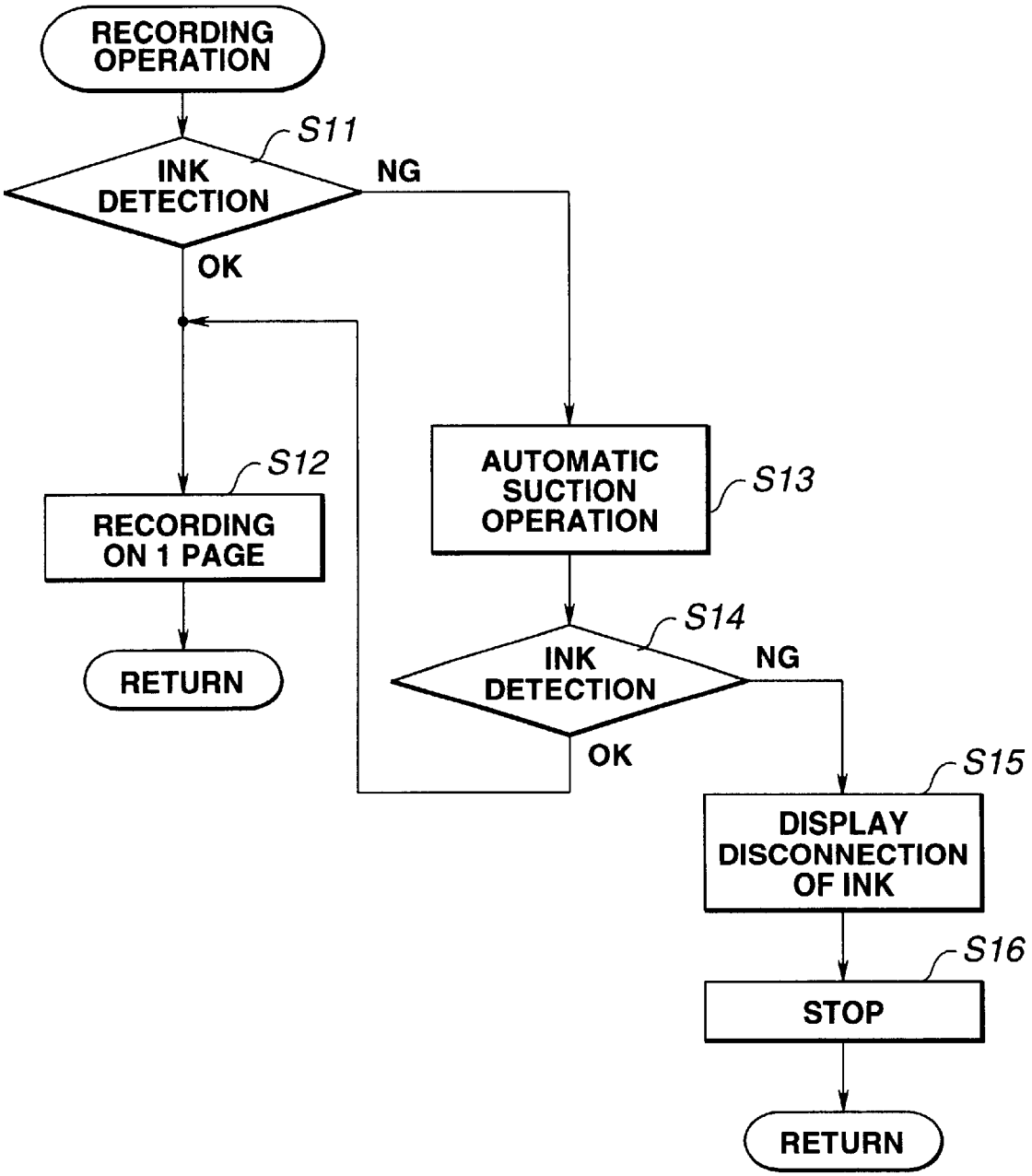
FIG. 8 is a flowchart illustrating ink detection processing in the first embodiment.

FIG. 8 is a flowchart illustrating the flow of ink detection. In the first embodiment, ink detection is performed immediately before each recording operation for one page.

When the recording operation has been started, then, in step S11, ink detection is performed. The detection is sequentially performed for all colors, i.e., Y. M, C and K. If ink detection has been performed and "disconnection of ink" from the ink tank and a portion near the discharging ports has not occurred, the process proceeds to step S12, where an ordinary recording operation is performed for one page. If "disconnection of ink" has been detected in step S11, the process proceeds to step S13, where a suction operation of sucking ink from the discharging port is performed for a color for which "disconnection of ink" has been detected. Then, in step S14, ink detection is again performed. If ink detection has been performed in step S14 and no "disconnection of ink", the process proceeds to step S12, where an ordinary recording operation is performed for one page. When ink detection has been performed in step S14 and no "disconnection of ink", the process proceeds to step S15. In step S15 an indication of ink, disconnection is displayed on the display device of the main body of the recording apparatus and is communicated to the control unit (host computer) of the recording apparatus, and appropriate recovery processing, such as notifying the user of the absence of ink and urging the user to exchange the ink tank, is performed. Furthermore, by indicating the color of the ink having "disconnection of ink", the user can perform appropriate processing.

Figure 9:
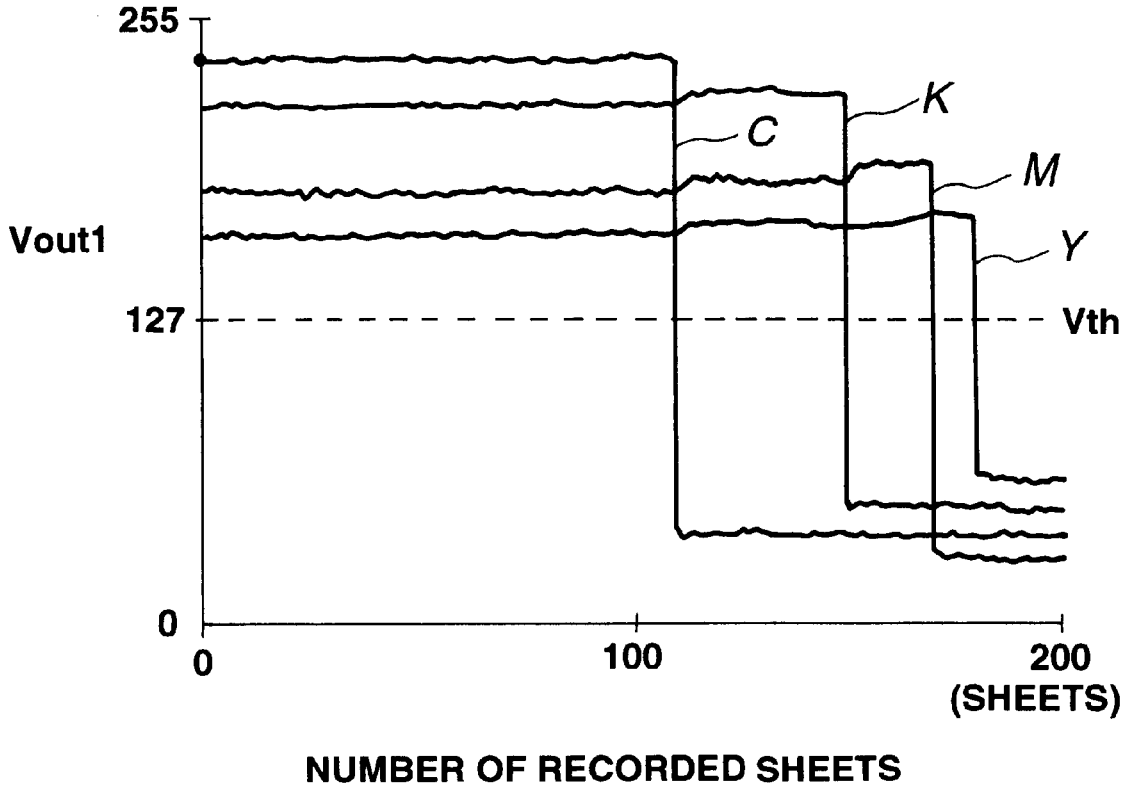
FIG. 9 is a graph illustrating data of a detection signal in ink detection in the first embodiment.

FIG. 9 is a graph showing basic data of detection signals when recording a specific pattern. In FIG. 9, the ordinate represents the level of the detection signal $V_{out}$1, and the abscissa represents the number of recorded sheets. The detection signal level represents a numerical value obtained after A/D conversion and calculation processing.

FIG. 9 illustrates a case in which recording has been performed up to 120 pages, 150 pages, 170 pages and 180 pages for C, Bk, M and Y, respectively, and then ink has been used up or disconnected. In FIG. 9, $V_{th}$ is a threshold level for determining a state of "disconnection of ink". If the value of $V_{out}$1 is greater than $V_{th}$, it is determined that ink is present. If the value of $V_{out}$1 is smaller than $V_{th}$, it is determined that "disconnection of ink" has occurred. The value of $V_{th}$ is made to be 127 commonly for all colors. In some measuring systems, it is necessary to optimize the value of $V_{th}$ for each, color, because a single value of $V_{th}$ cannot be commonly used depending on the shapes and the arrangements of the input terminal and the detection terminal. For example, if the position of the sensor is separated from the ink tank only for Y, it is necessary to reduce the value of $V_{th}$ for Y. The value of $V_{th}$ is also optimized depending on the configuration and the circuit constant of the detection circuit.

When the first color becomes in the state of "disconnection of ink", detection levels for other colors increase. This is due in part to electrostatic induction between juxtaposed ink tanks.

The basic data shown in FIG. 9 is experimentally obtained in order to confirm "disconnection of ink" for all of Y, M, C and K inks. Actually, for example, the user exchanges the ink tank of a color having "disconnection of color" upon detection of "disconnection of ink". Therefore, $V_{out}$1 does not remain at a low level after falling thereto.

Figure 10A:
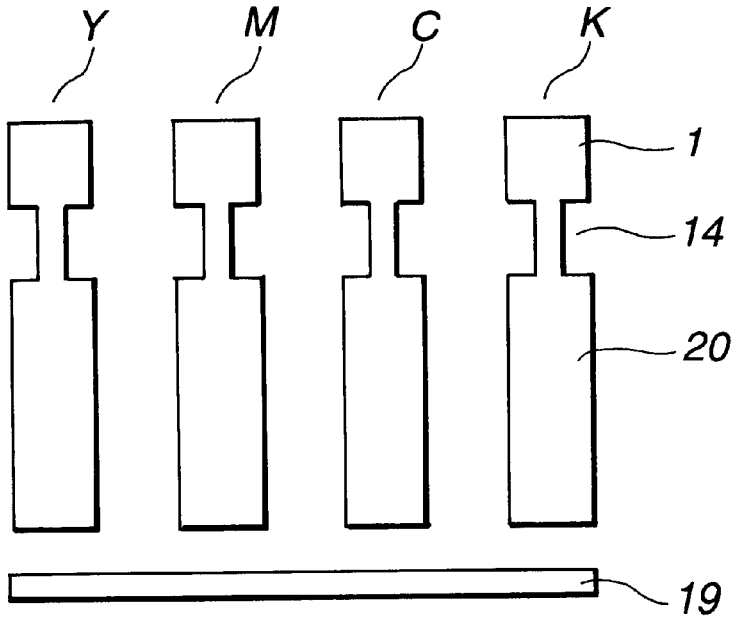
FIGS. 10A and 10B are diagrams illustrating a configuration which can detect a plurality of ink tanks.
Figure 10B:
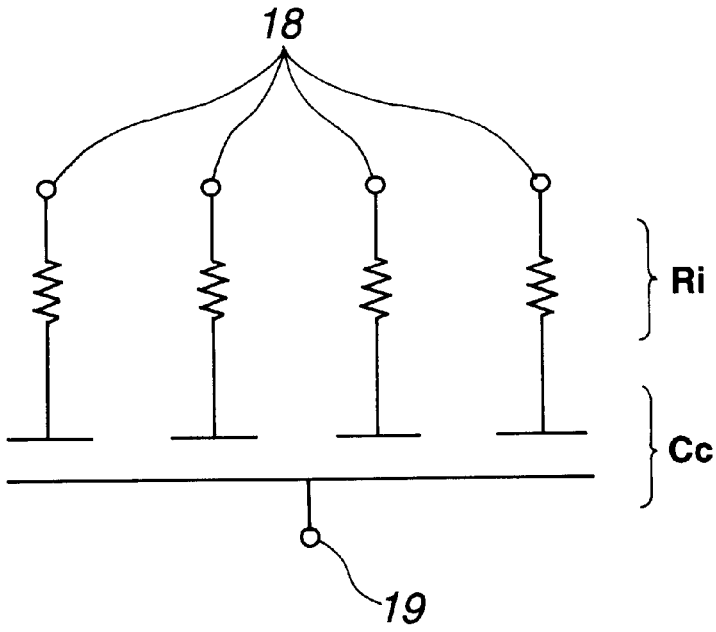

FIGS. 10A and 10B are diagrams illustrating the mechanism of detection of disconnection of ink for a plurality of colors, i.e., Y, M, C and K: FIG. 10A is a schematic diagram of recording heads; and FIG. 10B is a schematic diagram illustrating a simplified equivalent circuit of the recording heads.

A signal input from a portion near the discharging ports of the recording-head unit is transmitted to the ink tank via the recording head and the ink channel. The ink tank and the detection terminal 19 are electrostatically coupled according to electrostatic induction. According to such a configuration, although it is necessary to independently provide input terminals 18 for respective colors, a single detection terminal 19 may be provided commonly to a plurality of ink tanks, as shown in FIGS. 10A and 10B. Although detection terminals 19 may be provided for respective colors, the detection mechanism is simplified by providing a common detection terminal 19.

In the first embodiment, "disconnection of ink" and the absence of ink are processed as "disconnection of ink" without being discriminated. No problem arises because there is no need to discriminate between these two phenomena for, the user.

Second Embodiment

A second embodiment of the present invention will now be described in detail.

In the first embodiment, a description has been provided of the case in which ink tanks of a plurality of colors are separately provided and can be independently exchanged. However, the present invention is not limited to such a case.

Figure 11:
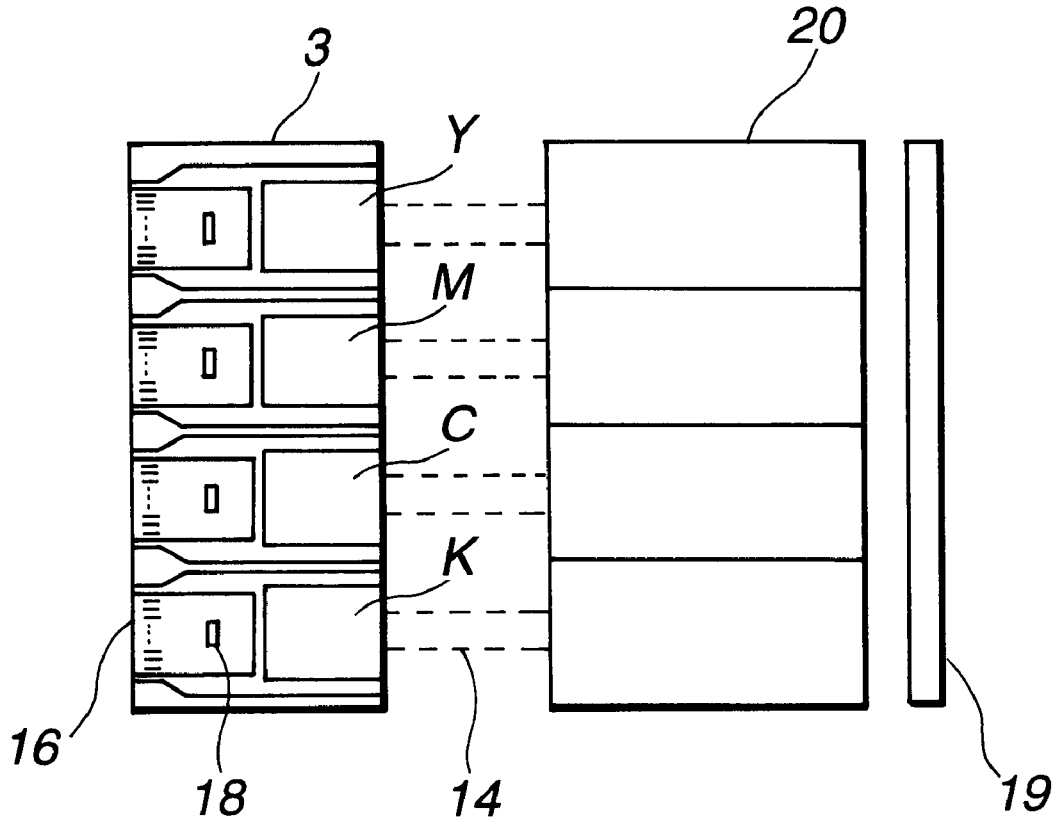
FIG. 11 is a diagram illustrating a configuration of integrating a plurality of ink tanks according to a second embodiment of the present invention.

FIG. 11 is a schematic diagram illustrating an example in which ink tanks 20 of a plurality of colors are integrated. The ink tanks 20 are also integrated with recording heads 16. The recording heads 16 for four colors, i.e., Y, M, C and K, are also integrated on a substrate. Each of the recording heads 16 and the corresponding ink tank 20 are connected to each other via an ink channel 14. A detection terminal 19 is provided at a position facing the integrated ink tanks 20. In this case, also, by allowing an input signal for each color to be independently input, ink detection can be performed by a single detection terminal 19.

The detection signal is similar between the case of the first embodiment, in which ink tanks can be independently exchanged, and the case of the integrated structure according to the second embodiment. However, high-precision ink detection can be performed in any of the cases by optimizing the constant of the detection circuit and the detection parameter system, including $V_{th}$ and the like. Accordingly, even if a structure other than the integrated structure is present, the ink detection system can be dealt with by preparing such optimum parameters in advance.

Third Embodiment

Although in the first embodiment, a description has been provided of the case of using colored inks, the present invention is not limited to such a case.

In the field of ink-jet recording, a technique of using a liquid which makes a dye in ink insoluble has been known. Such a technique is disclosed, for example, in Japanese Patent Laid-Open Application (Kokai) No. 64-63185 (1989) in which a colorless liquid for making a dye insoluble is caused to adhere to a recording sheet by an ink-jet printing head. By using such a liquid, it is possible to obtain an image having an excellent water resistant property and high density, and to obtain a high-quality image having an excellent coloring property by suppressing blurring between colors in color recording. Hence, this technique is attracting notice as an effective technique in ink-jet printing. A colorless or light-color liquid is used as the liquid of this kind in order to prevent degradation in the image quality by ordinary inks.

In the configuration of using a liquid which makes a dye insoluble according to the third embodiment, a description will now be provided of an approach to allow detection of the state of disconnection of the liquid in the liquid supply path or the remaining amount of the liquid in a manner similar to the case of ink.

Figure 12A:
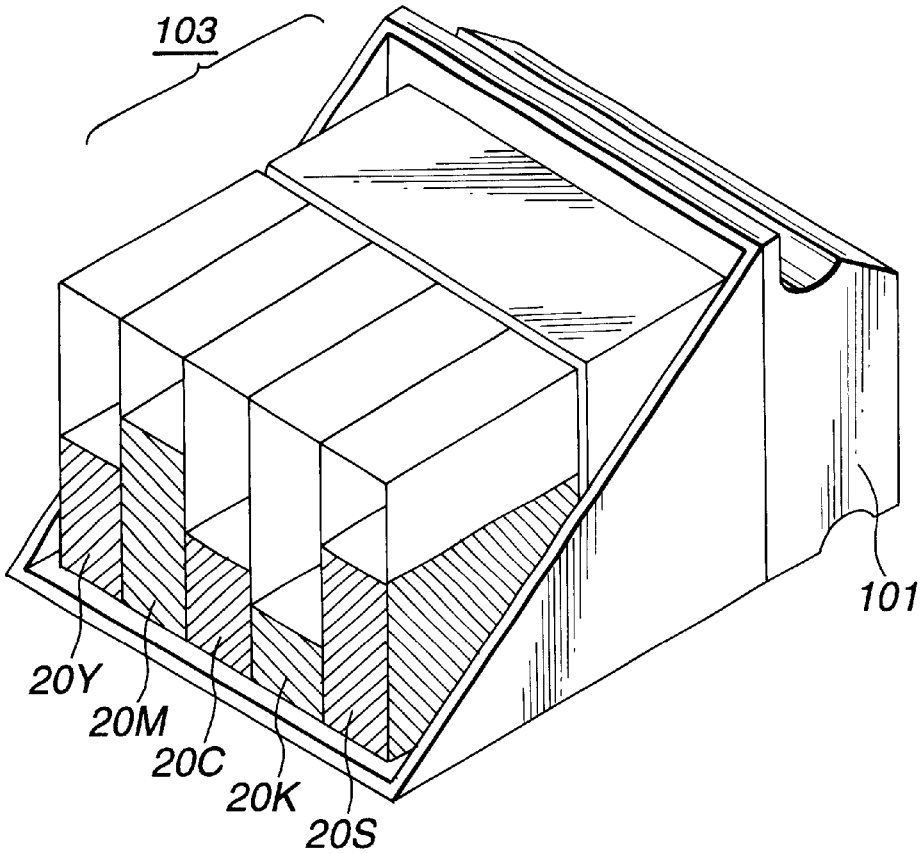
FIGS. 12A and 12B are diagrams illustrating the configuration of a recording unit which mounts an ink tank for a specific liquid for processing, according to a third embodiment of the present invention.
Figure 12B:
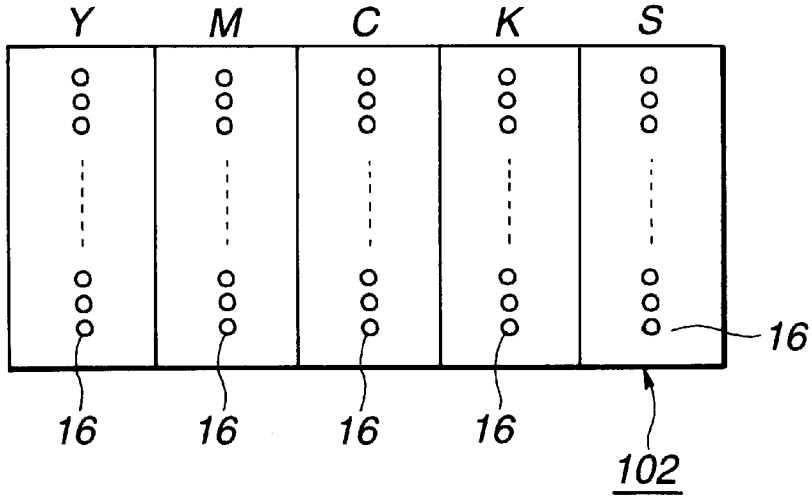

FIGS. 12A and 12B illustrate a case in which a transparent or light-colored liquid S is used in addition to inks. The configuration shown in FIG. 12A is obtained by adding an ink tank 20S for the liquid S to the configuration shown in FIG. 4, and a corresponding recording head to discharge the liquid S. FIG. 12B illustrates recording heads as seen from the side of the discharging ports, and a plurality of discharging ports 16 are provided for a head 102 for the liquid S as in the case of other heads.

The liquid S is used when a new effect can be obtained in the recorded image by reacting on or being mixed with color inks on a recording medium. In the third embodiment, a liquid which reacts on inks by being discharged onto ordinary paper is used in order to provide a high water resisting property even when a water resisting property could not previously have been obtained.

In the present invention, the same effects as in the foregoing embodiments can be obtained even when using the liquid S. However, it is necessary to add at least a circuit and a processing routine for detecting the liquid S to the configuration of the first embodiment.

Fourth Embodiment

Next, a fourth embodiment of the present invention will be described.

Although in the first embodiment, the second electrode is horizontally provided at a position adjacent to the lower portion of the ink tank, the second electrode may also be vertically provided. In the fourth embodiment, a second electrode, serving as a detection terminal, is vertically provided. The configuration of such a second electrode will now be described in detail. In the fourth embodiment, the configuration of portions other than the second electrode is the same as in the first embodiment, and a detailed description thereof will be omitted.

By vertically providing the second electrode, it is possible to detect not only "disconnection of ink", but also the level of the ink within the ink tank.

Figure 14:
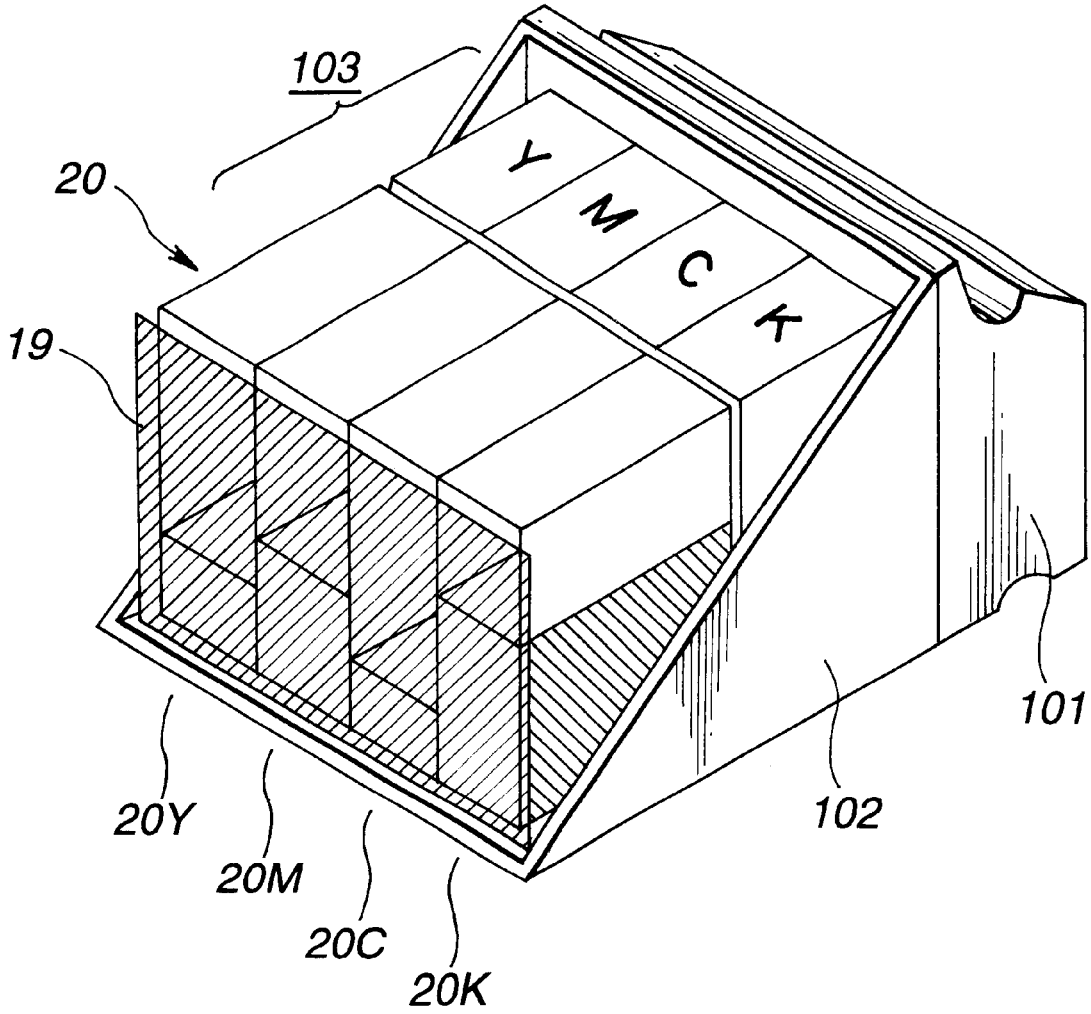
FIG. 14 is a diagram illustrating the configuration of a detection electrode according to a fourth embodiment of the present invention.

FIG. 14 is a diagram illustrating the case of vertically providing the second electrode in the ink tank. The second electrode is provided at a front side of the ink tanks 20 as seen in FIG. 14. Each ink faces the second electrode at the front side in accordance with the level of the ink.

According to this configuration, the electrostatic capacity between the ink within the ink tank and the second electrode changes in accordance with the level of the ink, so that a signal corresponding to the level can be detected.

As a result, as the level of the ink is higher, the level of the detection signal is larger. In the fourth embodiment, when measuring the level of the ink, since the level of the surface of the ink liquid changes due to swaying of the ink tank while the ink tank is moved, it is desirable to perform measurement when the recording heads are stationary.

Figure 15:
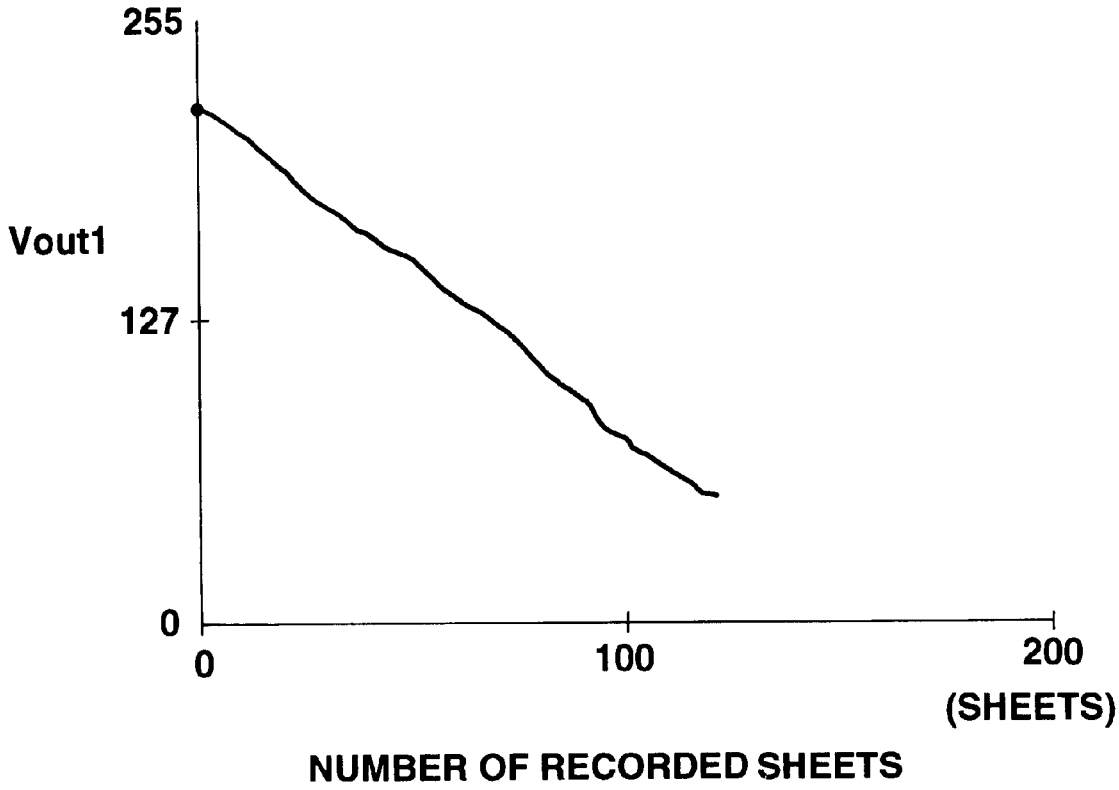
FIG. 15 is a graph illustrating changes in the level of a detection signal as the function of the number of recorded sheets in the fourth embodiment.

FIG. 15 is a graph illustrating the detection signal $V_{out}$1 when performing ink detection for magenta ink while continuing recording of a specific image. It is apparent from FIG. 15 that as the number of recorded sheets is larger, the level of the detection signal $V_{out}$ is smaller. From this level, it is possible to know the remaining amount of ink within the ink tank. In the fourth embodiment, by setting the level of a $V_{out}$ corresponding to the absence of ink, it is possible to determine that the ink is used up or that the ink tank is not mounted when the value of the $V_{out}$ reaches that level.

Although in the fourth embodiment, the second electrode is provided at the front side of the ink tanks, the second electrode may also be provided between the ink tanks and the recording heads. According to this configuration, an ink tank can be easily exchanged.

Fifth Embodiment

As can be understood from the equivalent circuit shown in FIG. 10B, ink detection can be performed by utilizing the detection terminal and the input terminal in the first embodiment as an input terminal and a detection terminal, respectively. In this case, when detecting inks of a plurality of colors, the input terminal is a common terminal, and the detection terminals are independent terminals for inks of respective colors.

In the fifth embodiment, the first electrode is provided at a portion near the discharging ports, and the second electrode is provided in the vicinity of the ink tanks. By inputting a signal of a certain voltage to the second electrode, and detecting the waveform of a voltage detected at the first electrode, continuity of the liquid from the ink tank to a portion near the discharging port, i.e., "disconnection of ink", is determined. According to such a configuration, also, the remaining amount of ink in the ink tank can be detected as in the fourth embodiment.

In the fifth embodiment, when performing measurement for inks of a plurality of colors, it is desirable to ground a detection terminal where measuring is not performed. According to this configuration, it is possible to minimize measurement error due to electrostatic induction between ink tanks of the inks of the plurality of colors.

Sixth Embodiment

Next, a sixth embodiment of the present invention will be described.

Although in the first embodiment, a timing for detecting ink is set to be immediately before starting recording of each page, the present invention is not limited to such setting.

For example, ink detection may be always performed during a recording operation. By adopting the configuration of a circuit capable of performing detection independent of a recording operation, and the configuration of a circuit less influenced by noise, ink can be always detected during a recording operation.

Alternatively, detection may be performed at a time interval of a few scanning operations in a serial-scanning recording apparatus. For example, detection may be performed every time the recording head performs ten scanning operations in the main scanning direction. According to this approach, the state of occurrence of "disconnection of ink" can be detected quickly than in the configuration of the first embodiment in which detection is performed for each page.

In another approach, the number of recorded dots may be counted, and ink detection may be performed every time recording of a predetermined number of dots is performed. In this case, in a configuration of using inks of a plurality of colors, by counting the number of recorded dots for each of the colors, detection can be performed at an appropriate timing for each color. It is preferable to detect ink not immediately after recording of a predetermined number of dots, but after completing a scan during which recording of the predetermined number of dots has been performed. This is to minimize the influence of noise during recording and noise in the carriage driving system.

As for the timing of detection, detection may be performed by being substantially synchronized with the timing of preliminary discharge, which is performed at a specific timing in order to maintain excellent discharge by discharging a dot which does not contribute to printing.

Alternatively, by ink detection immediately after a recording head or an ink tank has been exchanged or immediately after a recovery operation, it is possible to determine if recording can be performed in an excellent state.

As described above, ink detection may be performed at any time whenever necessary. This is because detection by the detection mechanism of the present embodiment can be performed within a very short time period without consuming ink, so that loss in ink and in the recording material is very small.

Seventh Embodiment

Next, a seventh embodiment of the present invention will be described.

Although in the first embodiment, ink detection is a routine in an ordinary recording operation, ink detection may be effectively performed during a recovery operation after a failure in recording, or after the recording apparatus has not been used for a long time period. The recovery operation is performed for removing ink having an increased viscosity within a discharging port of a recording head, or dust or the like adhered to the surface of a discharging port, by discharging the ink in the discharging port or by cleaning the surface of the discharging port, respectively. For example, a discharging recovery operation of discharging ink while moving the recording head to a position where recording is not performed, and a suction recovery operation of discharging ink from the discharging port by sucking it using a pump or the like are known.

Figure 13:
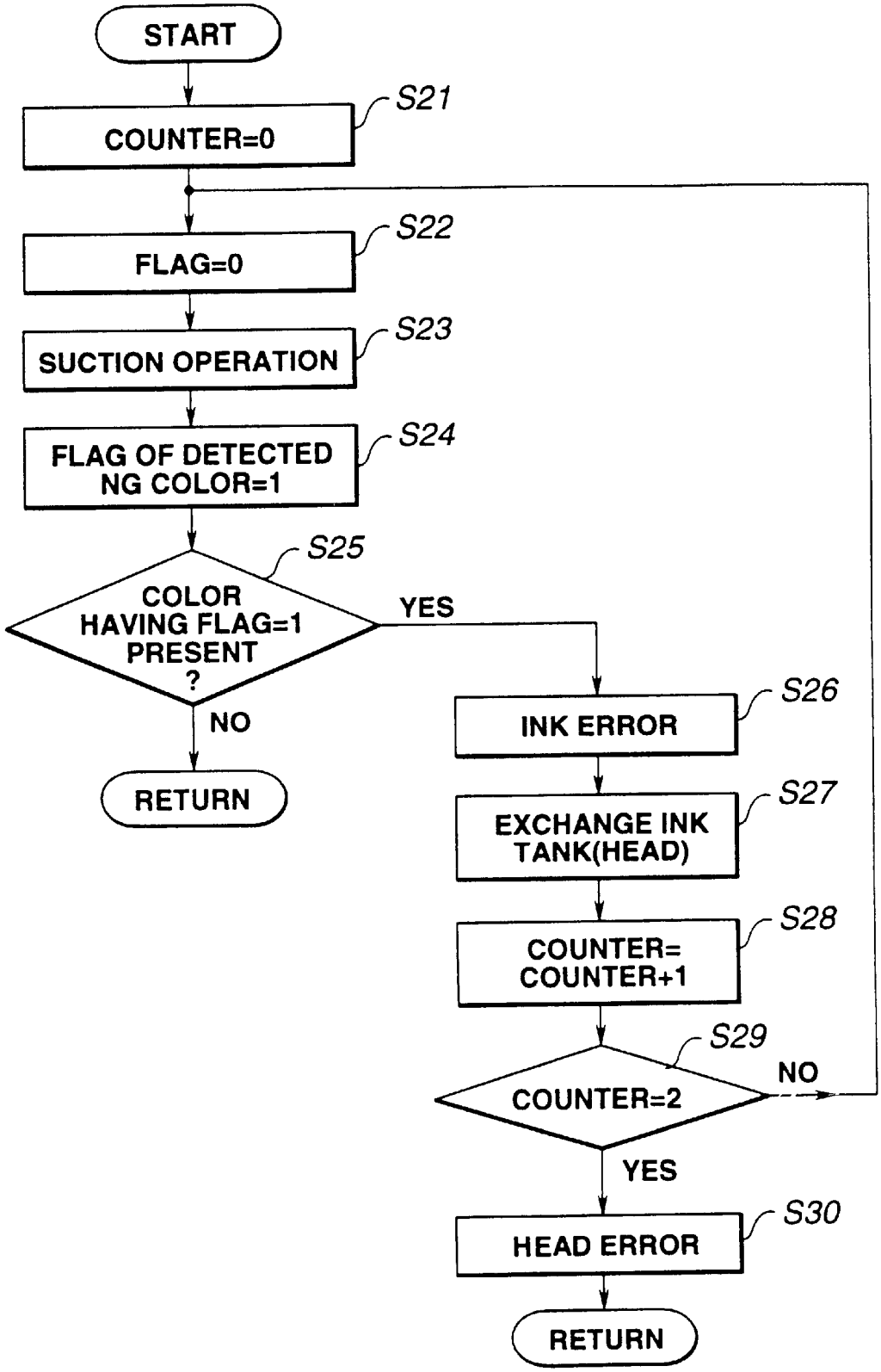
FIG. 13 is a flowchart illustrating ink detection processing during a recovery operation according to a seventh embodiment of the present invention.

FIG. 13 is a flowchart including an ink detection operation in a recovery operation routine. When the operation has been started, first, in step S21, a counter is reset. Then, in step S22, a flag is reset. If a plurality of colors are present, it is desirable that each color has its own independent flag. In such a case, all flats are reset in step S22. Then, in step S23, ink is discharged by performing a well-known suction operation. As described above, in the suction operation, ink is sucked by providing the distal end side of the discharging port with a negative pressure by a pump or the like. Then, in step S24, the ink detection described in one of the foregoing embodiments is performed. If there is a color determined to be NG after the detection, the flag for that color is set to 1. Then, in step S25, it is determined if there is a color whose flag=1. If the result of the determination in step S25 is negative, the process is terminated assuming that all the colors are OK, and the process returns to the first stage of the recovery operation routine. If the result of the determination in step S25 is affirmative, the process proceeds to step S26. In step S26, an indication of ink error is displayed. Then, in step S27, the user is urged to exchange the ink tank. If the recording head is integrated with the ink tank, the user is urged to exchange the head. Then, in step S28, the value of the counter is incremented by one. Then, in step S29, it is determined if the value of the counter equals 2. If the result of the determination in step S29 is negative, the process returns to step S22. If the result of the determination in step S29 is affirmative, that indicates that two suction operations have been performed in this recovery operation routine. Hence, this case is determined to correspond to error other than the absence of ink in the ink tank, so that, in step S30, head error is notified.

By thus performing ink detection during a recovery operation, the processing sequence becomes clear, and the user can easily understand the situation.

Eighth Embodiment

Next, an eighth embodiment of the present invention will be described.

Although in the first embodiment, a dedicated electrode is provided as the first electrode, the present invention is not limited to such a configuration.

Figure 16:
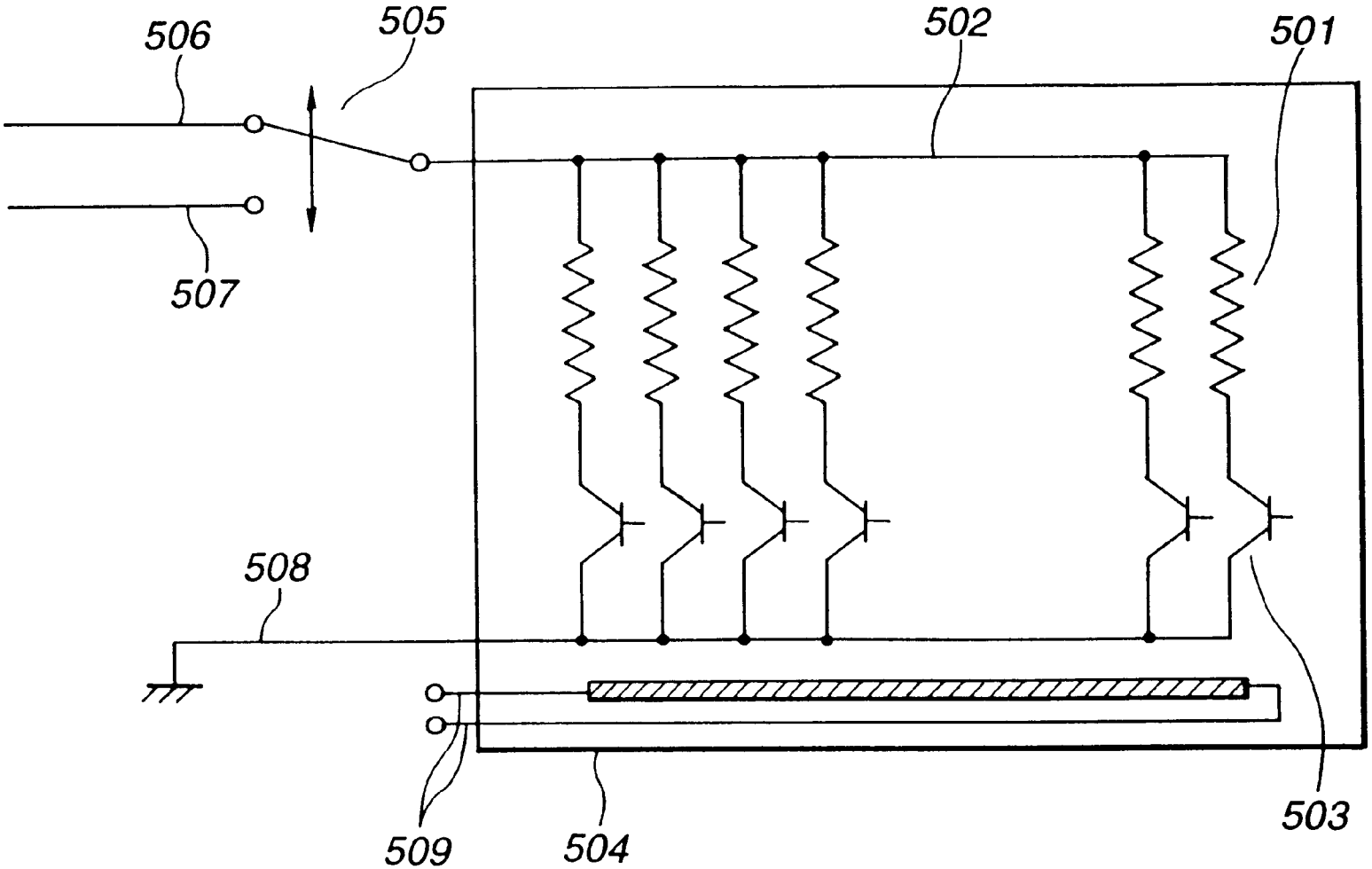
FIG. 16 is a diagram illustrating the configuration of an input electrode according to an eighth embodiment of the present invention.

FIG. 16 is a circuit diagram illustrating a case in which switching is performed between the first electrode (input electrode) according to the eighth embodiment and another input terminal of the recording head.

In FIG. 16, one end of each heating element 501 is connected to a common line 502, and the other end of the heating element 501 is connected to a transistor 503. The heating elements 501, the common line 502 and the transistors 503 are disposed on an element substrate 504 made of silicon.

A switch 505 switches the connection of the common line 502 between a heating-element driving power line 506 and a detection-signal input line 507 for ink detection.

In an ordinary operation, the switch 505 connects the common line 502 to the heating-element driving power line 506, and recording is performed by applying electric power to a desired heating element 501 by turning on/off the corresponding transistor 503 in accordance with recording data.

During ink detection, the switch 505 connects the common line 502 to the detection-signal input terminal 507, and an input signal is applied to the detection-signal input terminal 507. The common line 502 is electrostatically coupled with the detection terminal via the ink channel within the recording head, and continuity of ink from the ink tank to the discharging ports can be determined according to an output signal from the detection terminal.

In addition to the approach of the eighth embodiment in which switching is performed between the first electrode (ink-detection-signal input terminal) and the heating-element driving power line 506 of the recording head, any other electrode (terminal) electrically coupled with ink in the vicinity of the discharging ports may be used as an input terminal for an ink detection signal. Examples of such electrodes include a ground line 508, a temperature detection line 509 to which an element used for detecting the temperature of the recording head is connected, a pattern for detecting the resistance value provided in order to calculate the resistance value of the heating element which are provided on the element substrate, a protective film of the element substrate, an ID terminal for identifying the type of the recording head, or the like.

An electrode electrically coupled with ink in the vicinity of the discharging ports could be an electrode which directly contacts ink in the vicinity of the discharging ports within the recording head, or an electrode which is electrostatically coupled with ink although it does not directly contact the ink. The extent of electrostatic coupling depends on the input/detection frequency of the detection signal of the ink detection circuit.

When the electrode directly contacts ink in the vicinity of the discharging ports, the impedance between the ink and the electrode is small, thereby easing transmission of the detection signal. Hence, ink can be easily detected and the S/N ratio in detection increases.

As in the eighth embodiment, switching can be performed between the first electrode (ink-detection-signal input terminal) and another signal line of the recording head. As a result, ink detection can be easily performed even if there is no space to provide a dedicated ink-detection-signal input terminal on the element substrate 504 of the recording head.

Figure 17:
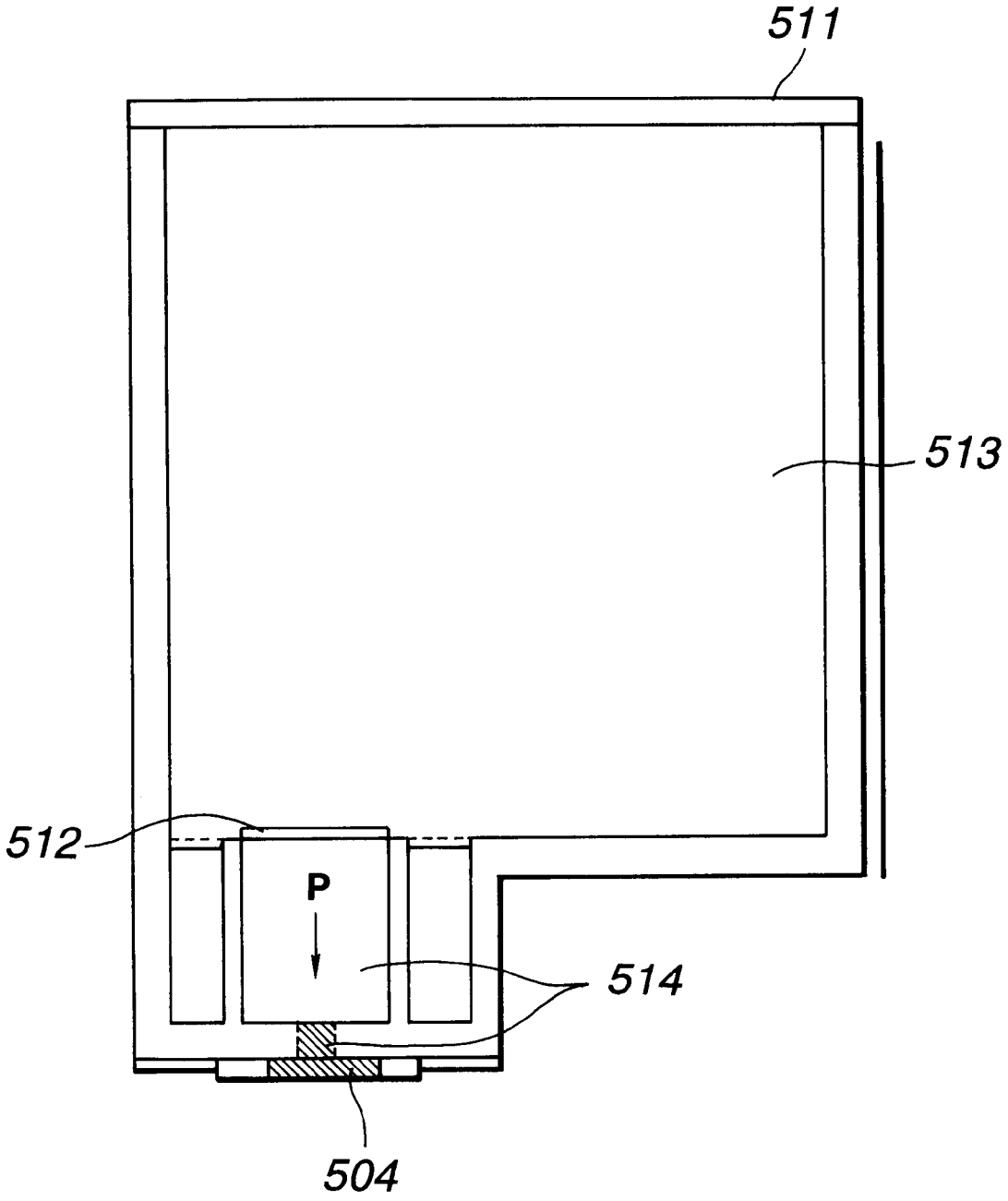
FIG. 17 is a cross-sectional view of the input electrode shown in FIG. 16.
Figure 18:
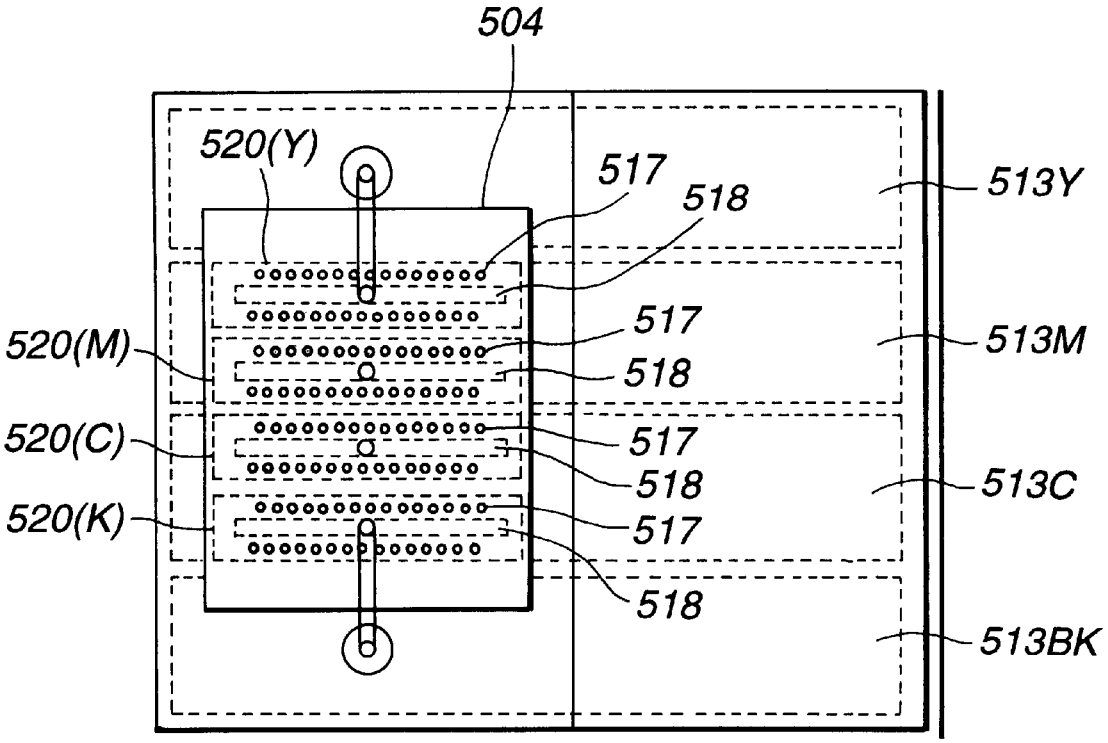
FIG. 18 is a front view of the input electrode shown in FIG. 16.
Figure 19:
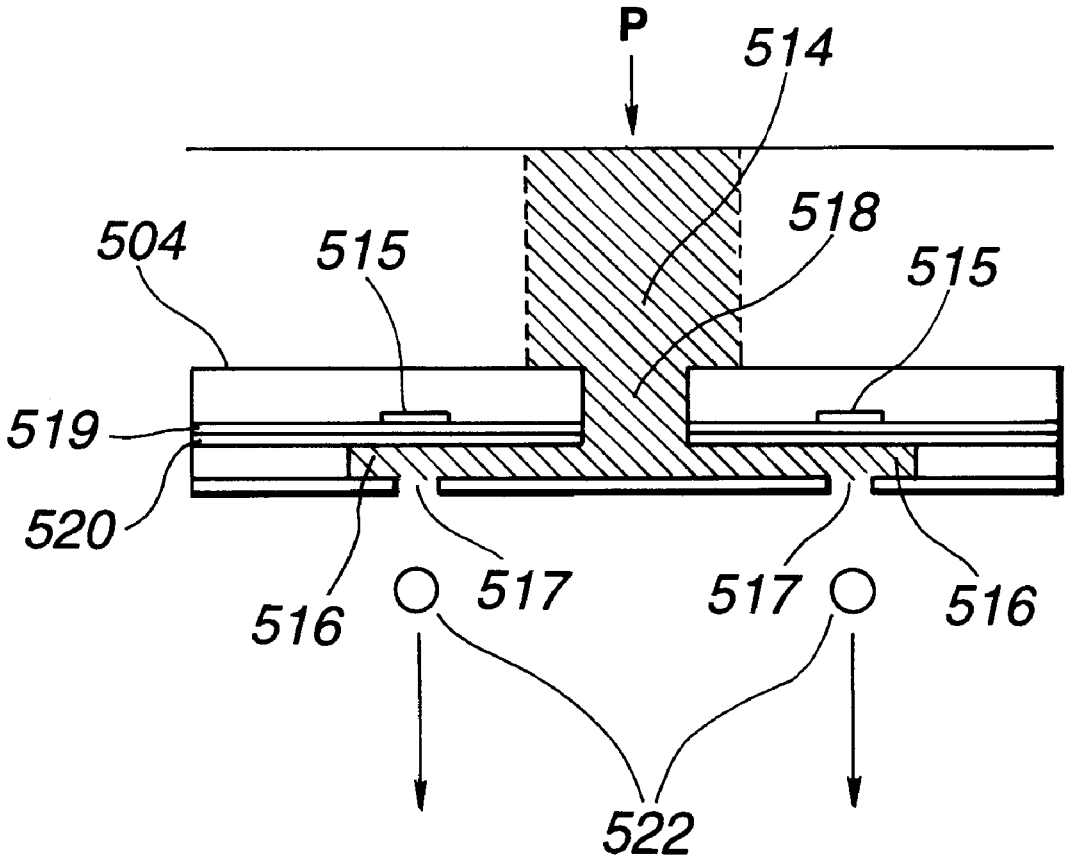
FIG. 19 is an enlarged cross-sectional view of a substrate for elements of the input electrode shown in FIG. 16.

FIGS. 17 through 19 are diagrams illustrating the detailed configuration of a specific recording head according to the eighth embodiment in which switching is performed between the first electrode (input electrode) and another input of the recording head. Inks of four colors, i.e., Y, M, C and K are used.

FIG. 17 is a cross-sectional view of the entire recording head. FIG. 18 is a front view of the recording head. FIG. 19 is an enlarged cross-sectional view of a portion for one color of the element substrate.

In FIGS. 17 through 19, in a recording head 511, an ink accommodating unit 513 and an ink discharging unit are integrated. The ink accommodating unit 513 occupies most of the space of the recording head. The recording head 511 includes an element substrate 504 made of silicon, the ink accommodating unit 513 for accommodating ink, and an ink channel 514 for supplying the element substrate 504 with ink accommodated in the ink accommodating unit 513. Heating elements 515 for discharging ink by heat, ink chambers 516 corresponding to the respective heating elements 515, discharging ports 517 for discharging ink, ink supply ports 518 are each formed in the silicon substrate in order to connect the ink chamber 516 to the ink channel 514, and first protective films 519 and second protective films 520 in a two-layer structure for preventing direct contact between the heating elements 515 and ink within the ink chambers 516. During recording, ink droplets are discharged from the discharging ports 517. The discharged ink is supplied from the ink accommodating unit 513 in the direction of an arrow P.

The heating elements, the ink chambers, the discharging ports and the protective films are provided independently for each of inks of a plurality of colors.

The first protective film 519 is made of silicon oxide and is an electric insulator. The second protective film 520 is made of a conductive material, such as tantalum oxide, tantalum nitride or the like. In addition to the role to protect the heating element, the second protective film 520 also operates as a detection-signal input terminal for ink detection as the first electrode. Since the second protective film 520 directly contacts ink within the ink chamber 516, the impedance between the protective film and the detection terminal when ink is present is small to allow direct transmission of a detection signal applied to the protective film to the ink, so that the level of the detection signal during ink detection is high, and the S/N ratio in ink detection increases.

The protective films 520 are independently provided for respective Y, M, C and R colors, and are electrically insulated from each other, as represented by 520(Y), 520(M), 520(C and 520/x) for Y, M, C and K, respectively, in FIG. 18. Therefore, ink detection can be independently performed for each color, and "disconnection of ink" can be independently detected.

Ninth Embodiment

Next, a ninth embodiment of the present invention will be described.

Although in the first embodiment the waveform of the signal input to the detection-signal input terminal for ink detection is rectangular, the present invention is not limited to such a case.

The waveform of a detection signal for ink detection may, for example, be sinusoidal or triangular. By detecting a change in the impedance between the detection-signal input terminal and the detection terminal by detecting the difference between the amplitudes of the input and output signals or the ratio of the amplitude of the input signal to the amplitude of the output signal, it is possible to detect continuity of ink from the ink tank to a portion near the discharging ports, and the amount of ink within the ink tank. Accordingly, a signal having any waveform may be used provided that the output signal can be determined relative to the input signal.

In a measuring system in which at least one of the first and second electrodes does not contact ink, since at least one electrostatic coupling is present, the impedance of the measuring circuit system has a reactance component. Accordingly, by adopting an appropriate value for the frequency of the input signal, it is possible to increase the ratio of the amplitude of the input signal to the amplitude of the output signal, and thereby to perform stable detection. By measuring the frequency characteristics of the impedance between the detection-signal input terminal and the detection terminal by detecting the ratio of the amplitude of the input signal to the amplitude of the output signal while changing the frequency of the input signal, it is also possible to detect continuity of ink from the ink tank to the discharging ports and the amount of ink within the ink tank.

Tenth Embodiment

Next, a tenth embodiment of the present invention will be described.

Figure 20A:
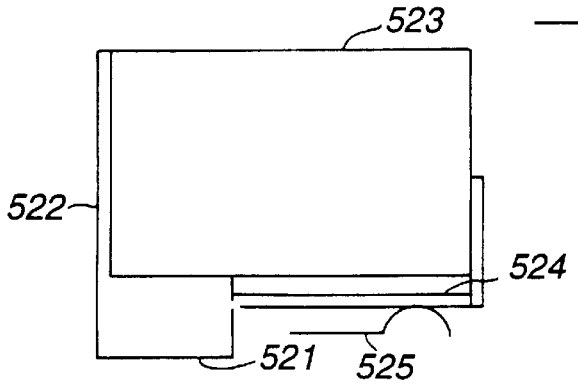
FIGS. 20A through 20F, and 21A through 21D are diagrams, each illustrating the position of a detection terminal in a tenth embodiment of the present invention.

FIGS. 20A through 20F and FIGS. 21A through 21D are diagrams illustrating a tenth embodiment of the present invention. FIG. 20A illustrates a case in which a head holder 522 including a discharging port 521 of a recording head and an ink accommodating unit 523 can be separated/connected. In FIG. 20A, a detection terminal 524 is provided at a position facing the ink accommodating unit 523 in a state of being integrated with the head holder 522 as the second electrode. The detection terminal 524 is electrically connected to a connection terminal 525 provided on a carriage (not shown), and can detect an output signal at the detection terminal 524 for a signal input to a detection-signal input terminal provided in the vicinity of the discharging port 521 of the recording head.

In this case, the first electrode is an input electrode which directly contacts ink in the vicinity of the discharging port of the recording head, and the second electrode is a detection electrode which does not contact ink within the ink tank.

By providing the detection terminal 524 in a state of being integrated with the head holder 522, the electrostatic coupling coefficient, i.e., the electrostatic capacity, between the ink accommodating unit 523 and the detection terminal 524 can be increased, resulting in an increase in the S/N ratio. Furthermore, since it is unnecessary to add a new structure to the ink accommodating unit 523 which is a consumable article, ink detection can be performed without increasing the running cost.

Figure 20B:
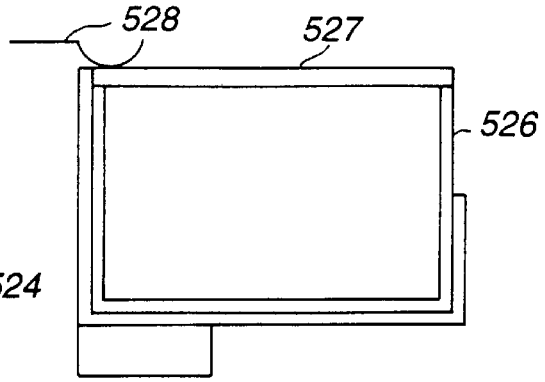

FIG. 20B illustrates a case in which a detection terminal 527 is provided at a portion of the outer wall of an ink accommodating unit 526. In this case, the detection terminal 527 comprises a conductive member made of a metallic material, such as aluminum or the like, formed on a metallic plate or a resin film by coating, vacuum deposition, or the like. The detection terminal 527 is electrically connected to a detection circuit unit via a connection terminal 528 provided on the carriage. Ink within the ink tank does not electrically contact the detection terminal 527, but the ink within the ink tank is electrostatically coupled with the electrode of the detection terminal 527. By providing the detection terminal 527 on the ink accommodating unit 526, it is possible to maximize the elctrostatic capacitance between the ink accommodating unit 526 and the detection terminal 527 and to increase the SIN ratio of the measuring system.

Figure 20C:
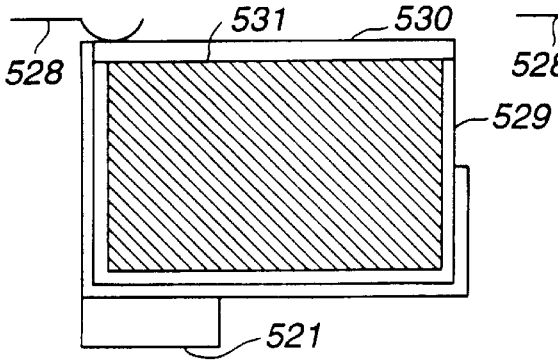

FIG. 20C illustrates a case in which a detection terminal 531 is provided over both surfaces of a cover 530 of an ink accommodating unit 529. In this case, a sponge-like foamed member is provided within the ink accommodating unit 529, and ink is filled within foam of the foamed member. By virtue of direct contact of the detection terminal 531 with ink within the ink accommodating unit 529, the S/N ratio further increases. In this case, the first electrode is an input electrode which directly contacts ink in the vicinity of the discharging port of the recording head, and the second electrode is a detection electrode, which contacts ink within the ink tank. In this system, continuity of ink from a portion near a discharging port 521 of the recording head to the inside of the ink accommodating unit 529.

Figure 20D:
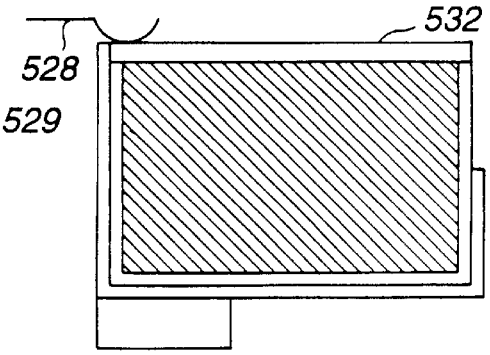

FIG. 20D illustrates a case in which a part of an ink accommodating unit 532 is formed by a conductive material, or the surface of the ink accommodating unit 532 is coated with a conductive material. Other portions are the same as those shown in FIG. 20C. In the configuration shown in FIG. 20D, the electrode portion can be provided with a lower cost than in the configuration shown in FIG. 20C.

Figure 20E:
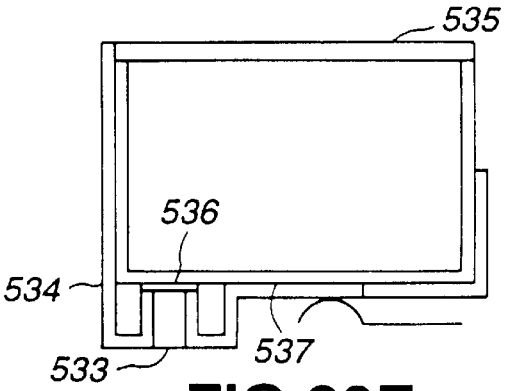

FIG. 20E illustrates a case in which a head holder 534 including a discharging port 533 of the recording head and an ink accommodating unit 535 can be separated/connected. In this case, a filter 536 is provided at an end portion of an ink channel, which connects the discharging port 533 and the ink accommodating unit 535 of the recording head, at the side of the head holder 534. The filter 536 is provided originally in order to remove dust and bubbles in the ink supplied from the ink accommodating unit 535 to the discharging port 533. In this case, the filter 536 is made of a conductive material, and is electrically connected to the carriage via a connection terminal 537. By using the filter 536 as a detection terminal for ink detection, it is possible to detect continuity of ink from the discharging port 533 to the filter 536 of the recording head. In this case, ink in the vicinity of the discharging port 533 of the recording head can be detected irrespective of the ink accommodating method of the ink accommodating unit 535.

Figure 20F:
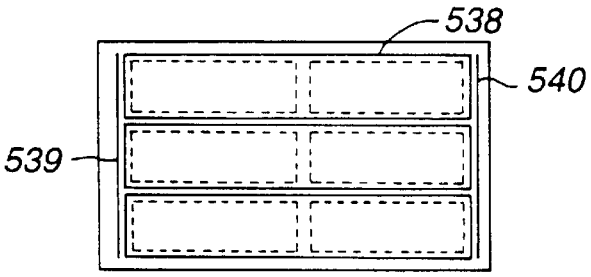

FIG. 20F illustrates a case in which a plurality of ink tanks are integrated. FIG. 20F is a diagram illustrating an ink accommodating unit 538 as seen from a direction perpendicular to the surface of the recording medium. As shown in FIG. 20F, the ink accommodating unit 538 comprises six integrated ink accommodating chambers for different colors arranged in the vertical and horizontal directions. In this case, detection terminals 539 and 540 are arranged so as to face across the ink accommodating chambers. The ink accommodating unit 538 can be detached in a direction perpendicular to the plane of FIG. 20F, so that ink can be detected without hindering exchange of ink.

Next, a description will be provided of configurations shown in FIGS. 21A through 21D.

Figure 21A:
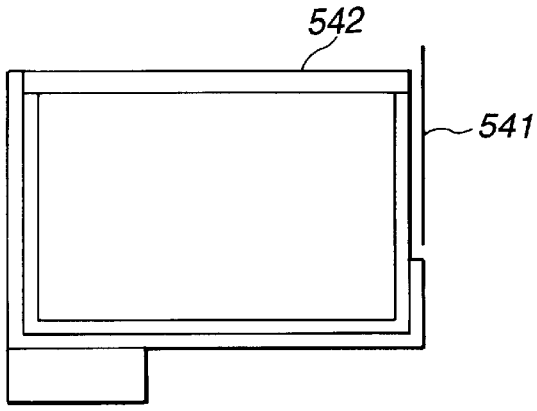

FIG. 21A illustrates a case in which a detection terminal 541 is provided at a fixed portion of a recording apparatus as the second electrode. In this case, by moving a carriage mounting a recording head, an ink accommodating unit 542 and the detection terminal 541 can be disposed so as to face each other in order to detect ink in unit 542. As the gap between the detection terminal 541 and the ink accommodating unit 542 decreases, the S/N ratio increases. According to this configuration, since the detection terminal 541 is provided at the fixed portion, the degree of freedom in arrangement, interconnection and the like increases, and a structure for obtaining an electrical signal from the carriage which is a moving unit becomes unnecessary.

Figure 21B:
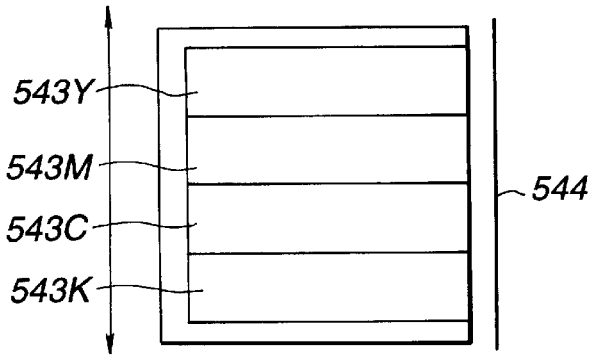

FIG. 21B illustrates a case in which a detection terminal 544 is provided at a fixed portion of a recording apparatus, and a plurality of colors are used. In this case, the size of the detection terminal 544 corresponds to the entire width of ink accommodating units 543Y, 543M, 543C and 543K accommodating inks of four colors, i.e., Y, M, C and K, respectively. By mounting the ink accommodating units 543 on a carriage and moving them in directions of the two-headed arrow, the ink accommodating units 543 and the detection terminal 544 can be disposed so as to face each other in order to detect ink in units 543. In this case, since the width of the detection terminal 544 is larger than the size of the ink accommodating units 543, exact positioning is unnecessary, so that ink can be detected with a simple configuration.

Figure 21C:
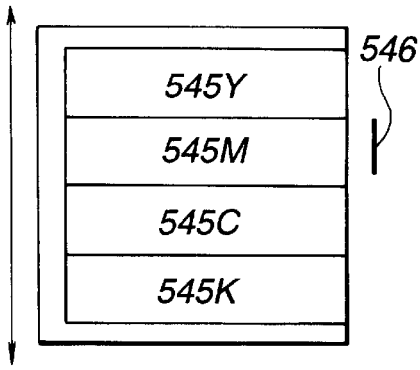

FIG. 21C illustrates a case in which a detection terminal 546 is provided at a fixed portion of a recording apparatus, and inks of a plurality of colors are used. The plurality of colors are detected by a single detection unit. The first electrode is an input electrode, which directly contacts ink in the vicinity of discharging ports of a recording head. The second electrode is a detection electrode, which does not contact ink within an ink tank. The widths of ink accommodating units 545Y, 545M, 545C and 545K accommodating inks of four colors, i.e., Y, M, C and K, respectively, in the scanning direction of a carriage (not shown) mounting the ink accommodating units are substantially equal, or only the width of the ink accommodating unit 545K is slightly larger than the widths of the other ink accommodating units. The width of the detection terminal 546 in the scanning direction of the carriage is slightly smaller than the width of each of the ink accommodating units. When the widths of the ink accommodating units differ, the width of the detection terminal 546 is made to be slightly smaller than the minimum width, of the ink accommodating units. By moving the carriage in directions of the two-headed arrow, one of the ink accommodating units 545 and the detection terminal 546 can be disposed so as to face each other in order to detect the ink of the corresponding color. During ink detection, it is desirable that the carriage causes the ink accommodating unit of the ink of a color to be detected and the detection terminal 546 to face each other in a stationary state, in order to prevent interference of a detection signal due to an electrical signal used to move the carriage, and to stably detect ink in the ink accommodating unit in a stationary state. Since the width of the detection terminal 546 is set to be slightly smaller than the width of each of the ink accommodating units 545Y, 545M, 545C and 545K, sequential detection of each color ink can be exactly performed without being influenced by ink accommodating units for color inks not to be detected. The case shown in FIG. 21C is particularly effective when the width of the detection terminal 546 disposed in the recording apparatus is not increased therefrom. Since the detection terminal 546 is apt to be influenced by unnecessary external noise due to static electricity and the like, it is preferable to minimize the area of the detection electrode.

Figure 21D:
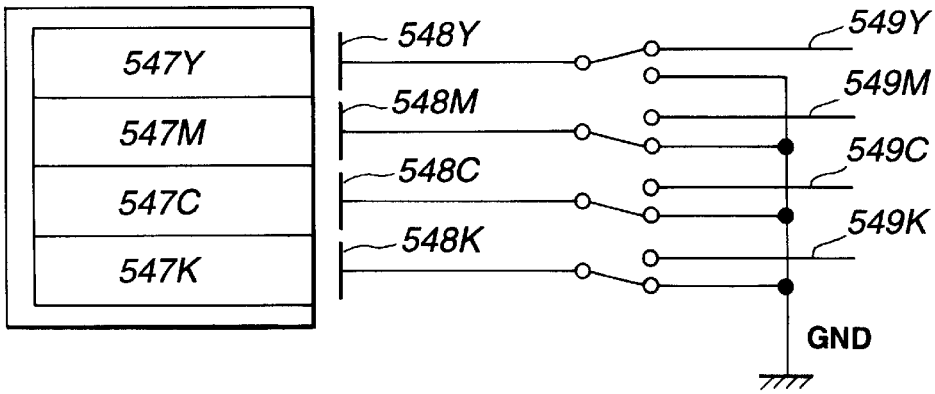

FIG. 21D illustrates a case in which inks of a plurality of colors are detected. The first electrode (not shown) is provided in the vicinity of discharging ports of a recording head, and is an-input terminal. The input terminal contacts ink. A plurality of input terminals may be provided independently for respective colors, or a single input terminal may be commonly used for all colors. In this case, input terminals are provided independently for respective colors. The second electrode is provided in the vicinity of ink tanks (ink accommodating units), and is a terminal. Detection terminals are provided independently for respective colors. Four colors Y, M, C and K are used, and four detection terminals 548Y, 548M, 548C and 548K are provided so as to face ink accommodating units 547Y, 547M, 547C and 547K accommodating four color inks, respectively. In this configuration, when detecting Y ink, the detection terminal 548Y is connected to an output terminal 549Y, and the other detection terminals 548M, 548C and 548K are grounded. When detecting inks of a plurality of colors, by grounding terminals for colors not to be measured, it is possible to reduce influence by other inks and to increase the S/N ratio in detection of colors to be measured.

Other Embodiments

In the foregoing embodiments, a description has been provided illustrating a method for discharging a liquid using electrothermal transducers for applying thermal energy to the liquid. However, the present invention is not limited to such a method, but any other discharging method may also be adopted. For example, a method in which piezoelectric elements serve as electromechanical transducers for applying a mechanical pressure as discharging energy, and in which a liquid droplet is discharged by the generated pressure, has been generally known.

Particularly, the present invention has excellent effects in a recording apparatus using an ink-jet-type recording head in which recording is performed by forming a liquid droplet utilizing thermal energy, in ink-jet recording methods.

Typical configurations and principles of such an ink-jet recording method are disclosed, for example, in U.S. Pat. Nos. 4,723,129 and 4,740,796. The disclosed method can be applied to both of so-called on-demand and continuous-type printing. In on-demand type printing at least one driving signal for causing a rapid temperature rise exceeding nucleate boiling is to an electrothermal transducer disposed so as to face a sheet holding a liquid (ink), or a liquid channel in accordance with recording information. As a result, thermal energy is generated in the electrothermal transducer to cause film boiling on the heat operating surface of the recording head and to form a bubble within the liquid (ink) corresponding to the driving signal. By discharging the liquid (ink) from the discharging opening using the growth and contraction of the bubble, at least one droplet is formed. It is preferable to provide the driving signal in the form of a pulse because the bubble can be instantaneously and appropriately grown and contracted and the discharging of the liquid (ink) with a high response speed can be achieved. A pulse-shaped driving signal such as ones disclosed in U.S. Pat. Nos. 4,463,359 and 4,345,262 is suitable. By adopting conditions described in U.S. Pat. No. 4,313,124 relating to the rate of temperature rise of the heat operating surface, more excellent recording can be performed.

In addition to the configuration of combining discharging ports, a liquid channel and electrothermal transducers (a linear liquid channel or an orthogonal liquid channel) as disclosed in the above-described patent applications, configurations described in U.S. Pat. Nos. 4,558,333 and 4,459,600, in which a heat operating unit is disposed at a bending region, may also be adopted for the recording head of the present invention. In addition, the present invention is also effective for a configuration disclosed in Japanese Patent Application Laid-Open (Kokai) No. 59-123670 (1984), in which a common slit is used as a discharging port for a plurality of electrothermal transducers, and to a configuration disclosed in Japanese Patent Application Laid-Open (Kokai) No. 59-138461 (1984), in which an aperture for absorbing the pressure wave of thermal energy is used as a discharging port. That is, according to the present invention, recording can be assuredly and efficiently performed irrespective of the form of the recording head.

The present invention is also effective for serial-type heads as described above, for example, a recording head fixed to the main body of the apparatus, an exchangeable chip-type recording head capable of electric connection to the main body of the apparatus and ink supply from the main body of the apparatus by being mounted on the main body of the apparatus, and a cartridge-type recording head having an ink tank provided as one body therewith.

As for the type of the number of recording heads to be mounted, a plurality of heads for a plurality of ink liquids having different colors and density values may be used. That is, the present invention is very effective for a recording mode using a single color, such as black or the like, an integrally formed recording head, a combination of a plurality of recording heads, and a recording apparatus which has at least one of a recording mode using a plurality of different colors and a recording mode of obtaining a full-color image by mixing colors.

Furthermore, the ink-jet recording apparatus of the present invention may be used as an image output terminal of an information processing apparatus, such as a computer or the like, a copier combined with a reader and the like, a facsimile apparatus having a transmission/reception function, and the like.

As described above, according to the present invention, it is possible to exactly detect the presence of ink in an ink tank or in an ink channel from the ink tank to an ink discharging unit, and a state in which the liquid channel is disconnected due to the presence of a bubble in the liquid channel. By appropriately disposing a terminal for detection, it is also possible to detect the remaining amount of ink within the ink tank, and a state of mounting-detaching of the ink tank in a configuration in which the ink tank and a recording head can be separated.

According to the configuration of the present invention, it is possible to inexpensively detect ink without providing an ink tank with detection means, and to perform ink detection for ink tanks having various kinds of inks (liquids) or for a plurality of recording heads by the same means.

According to the configuration of the present invention, it is also possible to detect ink having a very light color or a transparent liquid without being restricted by the composition and the color of the ink, to minimize the detection time period, and to detect ink without consuming the ink.

The individual components shown in outline or designated by blocks in the drawings are all well-known in the liquid detection method and liquid discharging device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid detection method in a configuration including a tank for accommodating a liquid, and a recording head for discharging the liquid supplied from the tank via a liquid channel from discharging ports onto a recording medium, said method comprising the steps of:

inputting a voltage having a predetermined waveform to a first electrode provided at a position near the discharging ports, said first electrode to electrically couple with liquid near the discharging ports;

detecting a waveform of a voltage generated at a second electrode provided at a position near the tank and outside the tank where the second electrode does not contact the liquid, the second electrode being positioned in parallel to a predetermined surface of the tank; and determining a presence of the tank, a remaining amount of the liquid within the tank, or continuity of the liquid from the tank to the position near the discharging ports based on the detected waveform of the voltage.

2. A liquid detection method according to claim 1, wherein the liquid is an ink having a coloring component for the recording medium, or a liquid having a component reacting with the ink which has electric conductivity.

3. A liquid detection method according to claim 2, wherein the first electrode contacts the liquid, and wherein the second electrode is provided at a position where it does not contact the liquid via an insulator for electrically insulating the second electrode from the liquid.

4. A liquid detection method according to claim 1, wherein the first electrode is provided at a position where it contacts the liquid via a protective film for electrically insulating the first electrode from the liquid.

5. A liquid detection method according to claim 4, wherein the area of a portion where the first electrode faces the ink and a distance from the first electrode to the ink are within a range to cause electrostatic induction from the first electrode to the ink by the input voltage having the predetermined waveform.

6. A liquid detection method according to claim 1, wherein the first electrode is provided at a position where it directly contacts the liquid.

7. A liquid detection method according to claim 1, wherein the second electrode is provided at a position where it contacts the liquid via a protective film for electrically insulating the second electrode from the liquid.

8. A liquid detection method according to claim 1, wherein an insulator for electrically insulating the second electrode from the liquid is provided between the liquid and the second electrode, and wherein the second electrode does not contact the liquid.

9. A liquid detection method according to claim 8, wherein the area of a portion where the second electrode faces the ink and a distance from the second electrode to the ink are within a range to cause electrostatic induction from the second electrode to the ink by the input voltage having the predetermined waveform.

10. A liquid detection method according to claim 1, wherein the recording head includes a plurality of electrothermal transducers for applying thermal energy to the liquid as discharging means for discharging the liquid from the discharging ports.

11. A liquid detection method according to claim 10, wherein said first electrode is a signal line for driving said electrothermal transducers.

12. A liquid discharging device including a tank for accommodating a liquid, and a recording head for discharging the liquid supplied from said tank via a liquid channel from discharging ports onto a recording medium, said device comprising:

a first electrode provided at a position near the discharging ports, said first electrode to electrically couple with liquid near the discharging ports;

a second electrode provided at a position near said tank and outside the tank where the second electrode does not contact the liquid, the second electrode being positioned in parallel to a predetermined surface of the tank;

detection means for inputting a voltage having a predetermined waveform to said first electrode and detecting a waveform of a voltage generated at said second electrode; and control means for determining a presence of said tank, a remaining amount of the liquid within said tank, or continuity of the liquid from said tank to the position near the discharging ports based on the waveform of the voltage detected by said detection means.

13. A liquid discharging device according to claim 11, wherein the liquid is an ink having a coloring component for the recording medium, or a liquid having a component reacting with the ink which has electric conductivity.

14. A liquid discharging device according to claim 12, wherein said first electrode is provided at a position where it contacts the liquid via a protective film for electrically insulating said first electrode from the liquid.

15. A liquid discharging device according to claim 14, wherein the area of a portion where said first electrode faces the ink and a distance from the first electrode to the ink are within a range to cause electrostatic induction from said first electrode to the ink by the input voltage having the predetermined waveform.

16. A liquid discharging device according to claim 12, wherein said first electrode is provided at a position where it directly contacts the liquid.

17. A liquid discharging device according to claim 12, wherein said second electrode is provided at a position where it contacts the liquid via a protective film for electrically insulating said second electrode from the liquid.

18. A liquid discharging device according to claim 12, wherein an insulator for electrically insulating said second electrode from the liquid is provided between the liquid and said second electrode, and wherein said second electrode does not contact the liquid.

19. A liquid discharging device according to claim 12, wherein the area of a portion where said second electrode faces the ink and a distance from the second electrode to the ink are within a range to cause electrostatic induction from said second electrode to the ink by the input voltage having the predetermined waveform.

20. A liquid discharging device according to claim 12, wherein said first electrode contacts the liquid, and wherein said second electrode is provided at a position where it does not contact the liquid via an insulator for electrically insulating said second electrode from the liquid.

21. A liquid discharging device according to claim 12, wherein said first electrode is provided at a position so as to directly contact the ink.

22. A liquid discharging device according to claim 12, wherein said first electrode is maintained at a 0-level voltage except when detecting the ink.

23. A liquid discharging device according to claim 12, wherein said first electrode also operates as an electrode terminal used for driving or controlling said recording head.

24. A liquid discharging device according to claim 12, wherein said recording head comprises a plurality of discharging means for discharging the liquid from the discharging ports, and wherein said first electrode is an electrode, commonly connected to predetermined discharging means from among said plurality of discharging means, for driving said predetermined discharging means.

25. A liquid discharging device according to claim 12, wherein said recording head comprises discharging means for discharging the liquid from the discharging ports, and wherein said first electrode is an electrode grounded for driving said discharging means.

26. A liquid discharging device according to claim 12, wherein said recording head comprises a plurality of discharging ports for discharging the liquid from the discharging ports, and wherein said first electrode is an electrode, connected to each of said plurality of discharging means, for driving said discharging means.

27. A liquid discharging device according to claim 12, wherein said first electrode comprises an identifying terminal where a signal for identifying said recording head is input.

28. A liquid discharging device according to claim 12, wherein said recording head comprises a plurality of electrothermal transducers for applying thermal energy to the liquid as discharging means for discharging the liquid from the discharging ports, and wherein said first electrode comprises a protective member for protecting said electrothermal transducers.

29. A liquid discharging device according to claim 28, wherein said protective member is made of tantalum or tantalum oxide.

30. A liquid discharging device according to claim 12, wherein said second electrode is provided at a position adjacent to said tank so as to be horizontal with respect to a lower portion of said tank.

31. A liquid discharging device according to claim 12, wherein said second electrode is provided at a position adjacent to said tank in a vertical direction on a wall portion of said tank.

32. A liquid discharging device according to claim 12, wherein said second electrode is provided at a terminal between said tank and said recording head, and wherein said control means determines a state of disconnection of ink in an ink channel between the terminal and the discharging ports.

33. A liquid discharging device according to claim 32, wherein said recording head comprises a filter portion for filtering the liquid supplied from said tank, and wherein the terminal is provided on said filter portion of said recording head, or on a joint portion between said tank and said recording head.

34. A liquid discharging device according to claim 12, further comprising:

a carriage for mounting said recording head and said tank; and scanning means for performing reciprocating scanning of said carriage relative to the recording medium, wherein said second electrode is provided on a head holder unit for supporting said recording head, or on said carriage.

35. A liquid discharging device according to claim 12, further comprising:

a carriage for mounting said recording head and said tank; and scanning means for performing reciprocating scanning of said carriage relative to the recording medium, wherein said second electrode is provided at a position of said liquid discharging device where the scanning by said carriage is not performed.

36. A liquid discharging device according to claim 12, wherein a plurality of said tanks and a plurality of said recording heads are provided so as to correspond to a plurality of liquids.

37. A liquid discharging device according to claim 36, wherein a plurality of said first electrodes and a plurality of said second electrodes are provided so as to correspond to the plurality of liquids.

38. A liquid discharging device according to claim 36, wherein a plurality of said first electrodes are provided so as to correspond to the plurality of liquids, and wherein said second electrode is integrally provided on said plurality of tanks at a position adjacent to said plurality of tanks.

39. A liquid discharging device according to claim 38, wherein a size of said second electrode substantially equals a width of said plurality of tanks.

40. A liquid discharging device according to claim 36, wherein said first electrode is provided commonly to the plurality of liquids, and wherein a plurality of said second electrodes are independently provided for corresponding ones of said plurality of tanks.

41. A liquid discharging device according to claim 40, wherein said control means sequentially detects the plurality of liquids.

42. A liquid discharging device according to claim 12, wherein said tank is integrally configured with respect to said recording head.

43. A liquid discharging device according to claim 12, wherein said tank is configured so as to be separable from said recording head, and wherein said tank and said recording head can be independently exchanged.

44. A liquid discharging device according to claim 12, further comprising:

display means for displaying a result of the determination by said control means.

45. A liquid discharging device according to claim 12, wherein said device is connected to host means capable of transferring data relating to recording, and wherein a result of the determination by said control means is transmitted to said host means.

46. A liquid discharging device according to claim 12, further comprising:

recovery means for performing a recovery operation for said recording head, wherein said control means causes said recovery means to perform a recovery operation when said control means has determined that ink is discontinuous in the liquid channel from said tank to one of the discharging ports of said recording head.

47. A liquid discharging device according to claim 12, wherein said recording head comprises a plurality of electromechanical transducers for applying discharging energy to the liquid as discharging means for discharging the liquid from the discharging ports.

48. A liquid discharging device according to claim 12, wherein said recording head comprises a plurality of electrothermal transducers for applying thermal energy to the liquid as discharging means for discharging the liquid from the discharging ports.

* * * * *

UNITED STATES PATENT AND TRADEMARK OFFICE

CERTIFICATE OF CORRECTION

PATENT NO. : 6,554,380 B2
DATED : April 29, 2003
INVENTOR(S) : Moriyama et al.

It is certified that error appears in the above-identified patent and that said Letters Patent is hereby corrected as shown below:

Title page,
Item [56], References Cited, U.S. PATENT DOCUMENTS, should read:
-- 5,635,961 6/1997 Sato …….. 347/7 --; and
Item [74], Inventors, "Scninto" should read -- Scinto --.

Column 2,
Line 22, "ink" should read -- ink tank, -- and "as," should read -- as --;
Line 35, "the of" should read -- the --; and
Line 36, "absence" should read -- absence of --.

Column 3,
Line 3, "liquid," should read -- liquid --; and
Line 30, "faces that" should read -- that faces --.

Column 7,
Line 51, "fom" should read -- from --.

Column 8,
Line 10, "the" (first occurrence) should be deleted; and
Line 27, "although" should read -- although --.

Column 10,
Line 58, "dection" should read -- detection --; and
Line 66, "electrostatially" should read -- electrostatically --.

Column 11,
Line 44, "$Vd_{th,}$" should read -- $V_{th,}$ --;
Line 45, "forgoing" should read -- foregoing --;
Line 48, "that" should read -- than --; and
Line 61, "electrochemical," should read -- electrochemical --.

Column 12,
Lines 19 and 22, "ink"," should read -- ink" is detected, --; and
Line 23, "S15" should read -- S15, -- and "ink," should read -- ink --.

Column 13,
Line 19, "phone-" should read -- pheno- --.

Column 14,
Line 64, "the level of a" should read -- a level of the --.

UNITED STATES PATENT AND TRADEMARK OFFICE

CERTIFICATE OF CORRECTION

PATENT NO. : 6,554,380 B2
DATED : April 29, 2003
INVENTOR(S) : Moriyama et al.

It is certified that error appears in the above-identified patent and that said Letters Patent is hereby corrected as shown below:

Column 15,
Line 49, “quickly” should read -- more quickly --; and
Line 54, “of” (first occurrence) should be deleted.

Column 16,
Line 1, “by” should read -- by performing --; and
Line 32, “flats” should read -- flags --.

Column 18,
Line 45, “520(C” should read -- 520(C) -- and “520/x” should read -- 520(K) --.

Column 19,
Line 59, “elctrostatic” should read -- electrostatic --; and
Line 61, “SIN” should read -- S/N --.

Column 20,
Line 7, “ink from” should read -- ink extends from --.

Column 21,
Line 28, “width,” should read -- width --;
Line 54, “an-input” should read -- an input --; and
Line 60, “terminal.” should read -- detection terminal. --.

Column 22,
Line 27, “is to” should read -- is applied to --.

Column 24,
Line 15, “via” should read -- due to --.

Column 25,
Line 8, “claim 11,” should read -- claim 12, --; and
Line 14, “via” should read -- due to --.

UNITED STATES PATENT AND TRADEMARK OFFICE

CERTIFICATE OF CORRECTION

PATENT NO. : 6,554,380 B2
DATED : April 29, 2003
INVENTOR(S) : Moriyama et al.

It is certified that error appears in the above-identified patent and that said Letters Patent is hereby corrected as shown below:

Column 27,
Line 16, "respect to" should be deleted.

Signed and Sealed this

Thirteenth Day of April, 2004

JON W. DUDAS
*Acting Director of the United States Patent and Trademark Office*